US008353189B2

(12) United States Patent
Bogdanov et al.

(10) Patent No.: US 8,353,189 B2
(45) Date of Patent: Jan. 15, 2013

(54) MANUAL OVERRIDE MECHANISM FOR ELECTROMECHANICAL LOCKS

(75) Inventors: Victor Bogdanov, Manchester, CT (US); John E. Walsh, III, Wallingford, CT (US); George Frolov, Farmington, CT (US); Alfred S. Levesque, Newington, CT (US)

(73) Assignee: Schlage Lock Company, Carmel, IN (US)

( * ) Notice: Subject to any disclaimer, the term of this patent is extended or adjusted under 35 U.S.C. 154(b) by 1117 days.

(21) Appl. No.: 11/651,641

(22) Filed: Jan. 9, 2007

(65) Prior Publication Data

US 2007/0157684 A1 Jul. 12, 2007

Related U.S. Application Data

(60) Provisional application No. 60/757,400, filed on Jan. 9, 2006.

(51) Int. Cl.
*E05B 47/06* (2006.01)

(52) U.S. Cl. ..... 70/472; 70/278.3; 70/279.1

(58) Field of Classification Search ..... 70/107, 70/149, 277, 278.2, 278.3, 278.7, 279.1, 70/472

See application file for complete search history.

(56) References Cited

U.S. PATENT DOCUMENTS

| | | | | |
|---|---|---|---|---|
| 5,475,996 | A * | 12/1995 | Chen | 70/279.1 |
| 5,640,863 | A * | 6/1997 | Frolov | 70/277 |
| 5,987,945 | A * | 11/1999 | Ruano Aramburu | 70/279.1 |
| 6,286,347 | B1 * | 9/2001 | Frolov | 70/472 |
| 6,354,121 | B1 * | 3/2002 | Frolov | 70/277 |
| 6,363,762 | B1 * | 4/2002 | Kueng | 70/278.3 |
| 6,487,884 | B1 * | 12/2002 | Constantinou | 70/277 |
| 6,622,535 | B2 * | 9/2003 | Chiang et al. | 70/277 |
| 6,651,468 | B2 * | 11/2003 | Aramburu et al. | 70/279.1 |
| 6,725,693 | B2 * | 4/2004 | Yu et al. | 70/107 |
| 6,758,070 | B2 * | 7/2004 | Yu et al. | 70/107 |
| 6,837,081 | B2 * | 1/2005 | Ruano Aramburu et al. | 70/218 |
| 7,007,526 | B2 * | 3/2006 | Frolov et al. | 70/277 |
| 7,096,697 | B2 * | 8/2006 | Keightly | 70/279.1 |
| 7,096,698 | B2 * | 8/2006 | Walsh et al. | 70/472 |
| 7,181,940 | B2 * | 2/2007 | Lin | 70/472 |
| 2002/0017121 | A1 * | 2/2002 | Bates et al. | 70/472 |
| 2003/0106357 | A1 * | 6/2003 | Keightley | 70/279.1 |
| 2004/0177663 | A1 * | 9/2004 | Walsh et al. | 70/472 |
| 2005/0050928 | A1 * | 3/2005 | Frolov et al. | 70/278.3 |

FOREIGN PATENT DOCUMENTS

EP 1154105 A2 * 11/2001

* cited by examiner

*Primary Examiner* — Christopher Boswell
(74) *Attorney, Agent, or Firm* — Michael Best & Friedrich LLP

(57) ABSTRACT

An override mechanism is for an electronic door lock assembly that includes a handle, a retractor and an electronic clutch mechanism with a movable coupler and an actuator. The coupler operatively connects the handle with the retractor when the coupler is located in an engaged position and the actuator is operable to displace the coupler between a nonengaged position and the engaged position. The override mechanism includes a movable override member configured to displace the clutch coupler between the nonengaged and engaged positions. The override member also retains the clutch coupler at the engaged position when the override member is disposed at an unlock position and prevents displacement of the coupler during actuator operation when the override member is disposed at a lockout position. Further, a manual drive, preferably including a cylinder lock, is configured to displace the override member between the unlock and lockout positions.

28 Claims, 21 Drawing Sheets

MANUAL OVERRIDE MECHANISM FOR ELECTROMECHANICAL LOCKS

This application claims priority to U.S. Provisional Application Ser. No. 60/757,400, filed Jan. 9, 2006, the entire contents of which are incorporated herein by reference.

The present invention relates to a lock assemblies, and more specifically to lock assemblies that incorporate electromechanical clutch devices.

Electromechanical locks typically include either a directly actuated locking member or a clutch mechanism that alternatively connects and disconnects an exterior handle with a retractor. Such clutch mechanisms generally include a movable member that releasably couples with the exterior handle and an electronic actuator for controllably displacing the movable member. The clutch mechanism is operated in response to an authorized input, such as a code entered in a keypad or by a swipe card, which is received by a controller. The controller then generates and transmits a control signal to the actuator, such that the movable clutch member is appropriately operated.

SUMMARY OF THE INVENTION

In one aspect, the present invention is an override mechanism for an electromechanical door lock assembly, the lock assembly including a handle, a retractor and an electromechanical clutch mechanism with a movable coupler and an actuator. The coupler operatively connects the handle with the retractor when the coupler is located in an engaged position and the actuator is operable to displace the coupler between a nonengaged position and the engaged position. The override mechanism comprises a movable override member is configured to displace the clutch coupler between the nonengaged and engaged positions and to retain the clutch coupler at the engaged position when the override member is disposed at an unlock position. The override member is further configured to prevent displacement of the coupler during actuator operation when the override member is disposed at a lockout position.

In another aspect, the present invention is also an actuator assembly for a door lock assembly, the lock assembly including a movable latch, a retractor for displacing the latch and a handle for operating the retractor. The actuator assembly comprises a clutch mechanism including a movable coupler and an actuator, the coupler being configured to operatively connect the handle with the retractor when the coupler is located in an engaged position. The actuator is operable to displace the clutch coupler between a nonengaged position and an engaged position. Further, a movable override member is configured to displace the clutch coupler between the nonengaged and engaged positions and to retain the clutch coupler at the engaged position when the override member is disposed at an unlock position. The override member is also configured to prevent displacement of the coupler during actuator operation when the override member is disposed at a lockout position.

In a further aspect, the present invention is also a door lock assembly comprising a latch engageable with a strike, a retractor configured to displace the latch, and a handle operatively coupleable with the retractor. A coupler is configured to operatively connect the handle with the retractor and is displaceable between an engaged position at which the handle is coupled with the retractor and a nonengaged position at which the handle is noncoupled with the retractor. An electromechanical actuator is configured to displace the coupler between the nonengaged and engaged positions. Further, a movable override member is configured to displace the clutch coupler between the nonengaged and engaged positions and to retain the clutch coupler at the engaged position when the override member is disposed at an unlock position. The override member is further configured to prevent displacement of the coupler during actuator operation when the override member is disposed at a lockout position.

In yet another aspect, the present invention is again an override mechanism for an electromechanical door lock assembly, the lock assembly including a handle, a retractor and an electromechanical clutch mechanism with a movable coupler and an actuator. The coupler operatively connects the handle with the retractor when the coupler is located in an engaged position and the actuator is operable to displace the coupler between a nonengaged position and the engaged position. The override mechanism comprises a manually movable override member is configured to displace the clutch coupler between the nonengaged and engaged positions and to retain the clutch coupler at the engaged position when the override member is disposed at an unlock position.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 2:
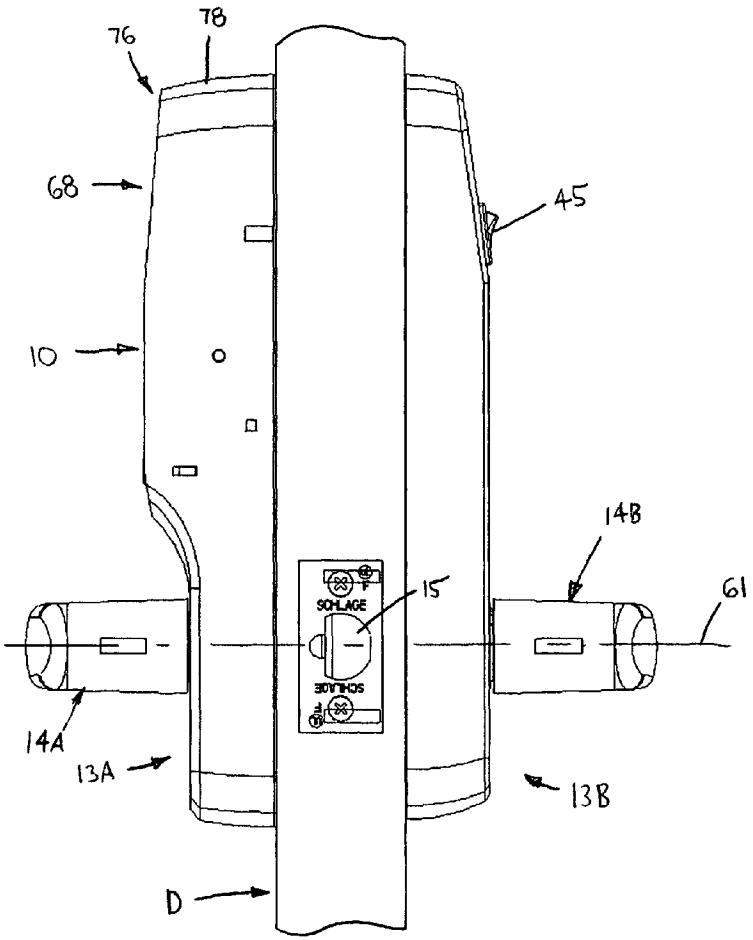
FIG. 2 is a side elevational view of the lock assembly of FIG. 1.
Figure 1:
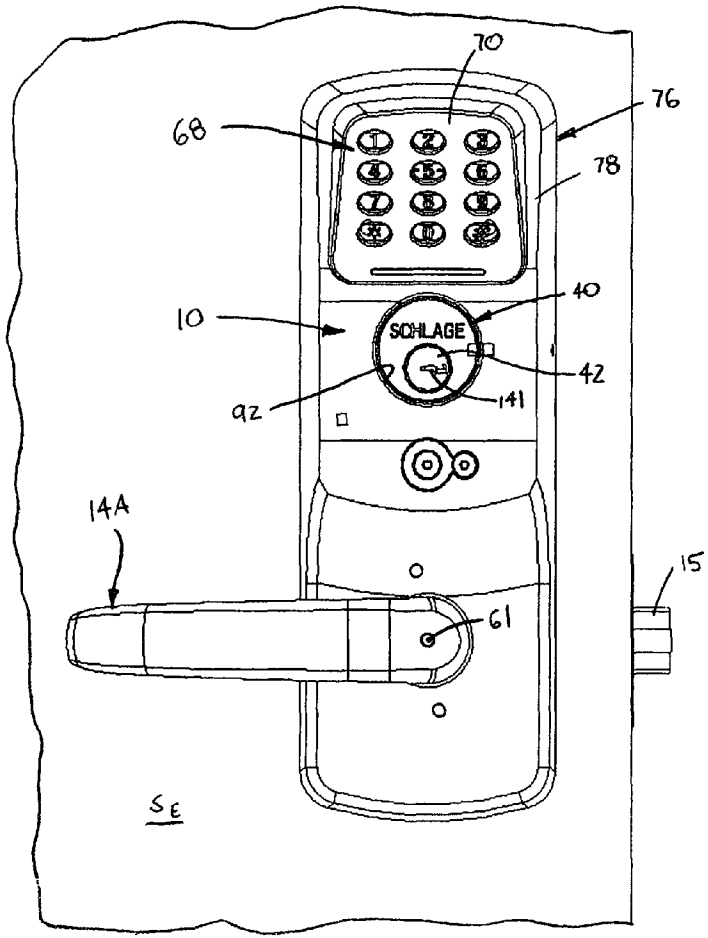
FIG. 1 is a front elevational view of a first construction of an electromechanical lock assembly that includes an override mechanism in accordance with a first embodiment of the present invention, the lock assembly being shown mounted to a door.
Figure 3:
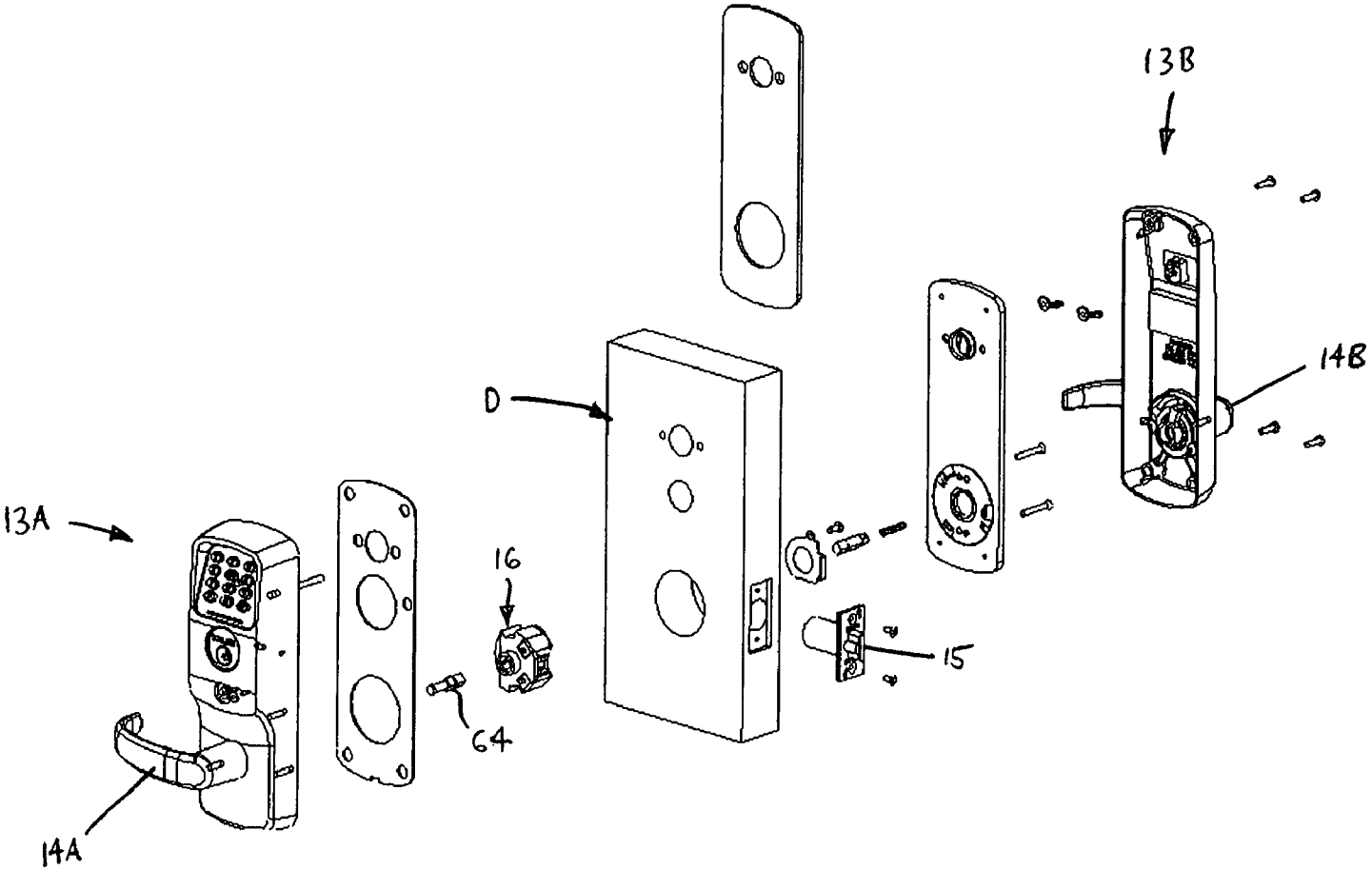
FIG. 3 is an exploded view of the lock assembly of FIG. 1.
Figure 4:
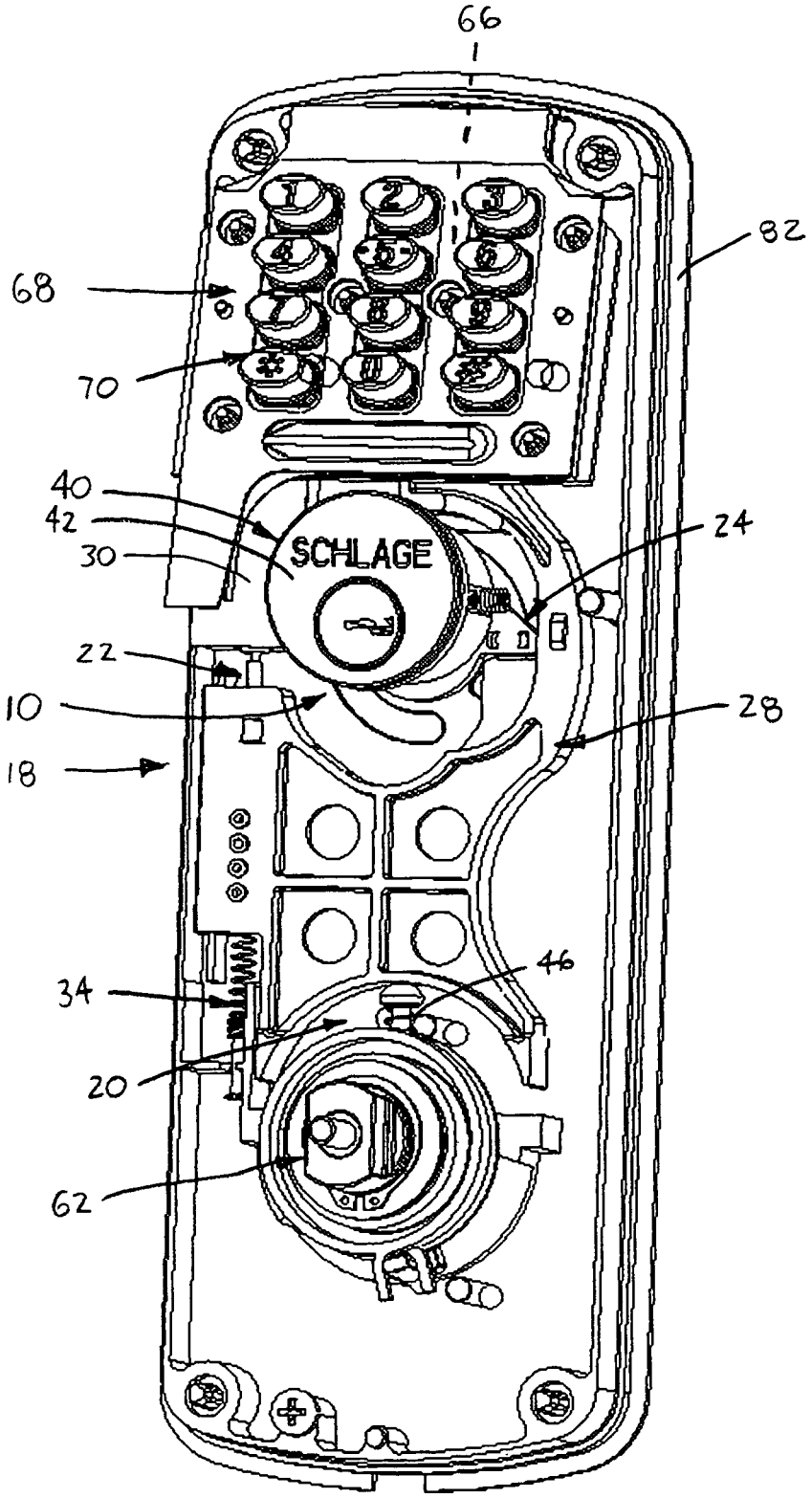
FIG. 4 is a front perspective view of the lock assembly and override mechanism, shown without a housing shell and with an outer spindle partly broken-away.

Certain terminology is used in the following description for convenience only and is not limiting. The words "lower", "upper", "upward", "down" and "downward" designate directions in the drawings to which reference is made. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. Furthermore, the term "position" is used herein to indicate a position, location, configuration, orientation, etc., of one or more components of the lock assembly, such as along or about respectively a linear or rotational axis, and each is depicted in the drawings with reference to a randomly selected point on the item being described. Such movement reference points, and displacement axes, in the drawing figures are randomly selected for convenience only and have no particular relevance to the present invention. The terminology includes the words specifically mentioned above, derivatives thereof, and words of similar import.

Figure 9:
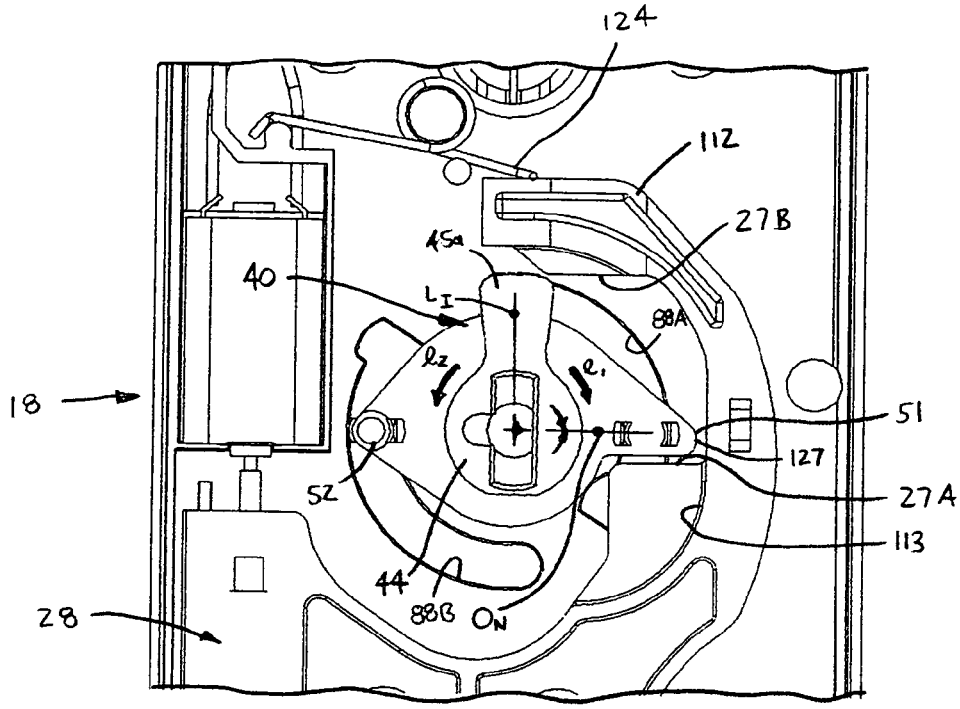
FIG. 9 is an enlarged, broken-away front plan view of the override mechanism and clutch actuator body of FIG. 6, shown with a cylinder lock output cam at an initial configuration.
Figure 10:
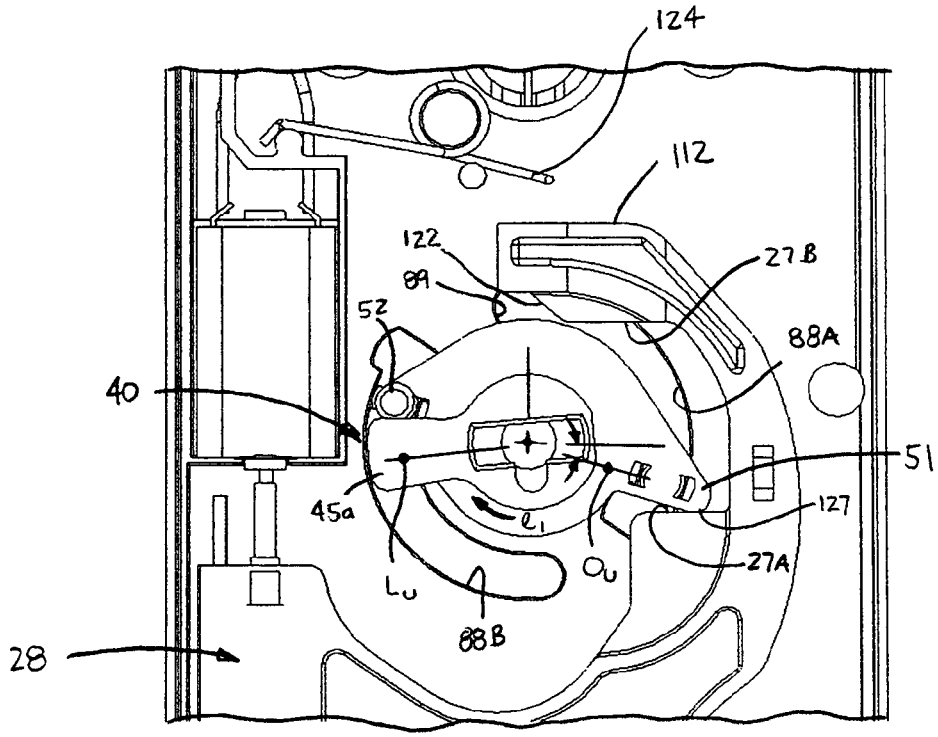
FIG. 10 is an enlarged, broken-away front plan view of the override mechanism and clutch actuator body of FIG. 7, shown with the cylinder lock cam at an unlock configuration.
Figure 11:
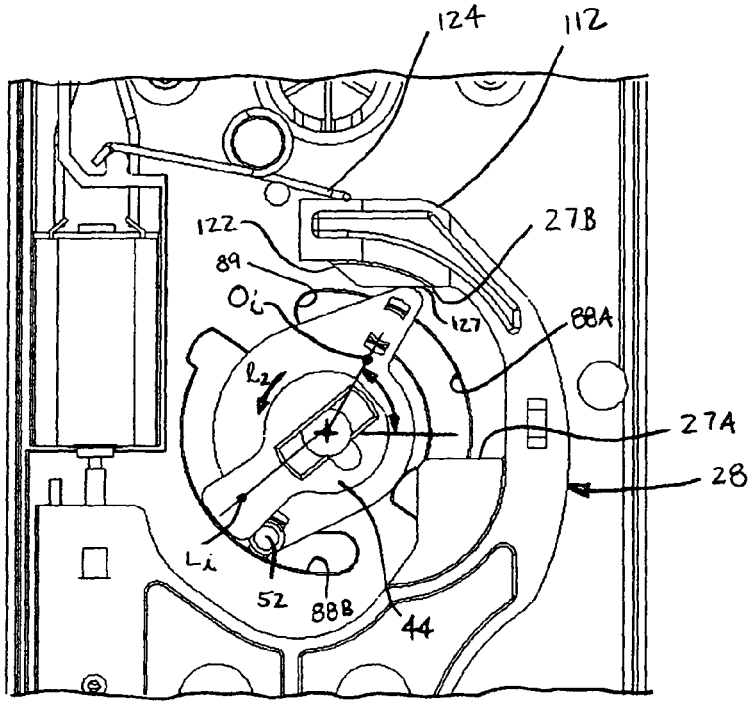
FIG. 11 is another view of the components of FIG. 9, shown with the override member in an intermediate position proximal to the lockout position, the actuator body proximal to the inoperative position, and the cylinder lock approaching the lockout configuration.

Referring now to the drawings in detail, wherein like numbers are used to indicate like elements throughout, there is shown in FIGS. 1-29 an override mechanism 10 for an electromechanical lock assembly 12, in accordance with the present invention. The lock assembly 12 is preferably mounted to a door D and includes at least one and preferably two handles 14A, 14B, a latch 15, a retractor 16, and an electromechanical clutch mechanism 18 with a movable coupler 20 and an actuator 22. The coupler 20 operatively connects the exterior or "outer" handle 14A with the retractor 16 when the coupler 20 is located in an engaged position $C_E$ (FIGS. 7, 14 and 22) and the actuator 22 is operable to displace the coupler 20 between a nonengaged position $C_N$ (FIGS. 6, 8 and 13) and the engaged position $C_E$. The override mechanism 10 basically comprises a movable override member 24 for manually moving the coupler 20 and for maintaining the coupler 20 in the nonengaged position $C_E$ against the operation of the clutch actuator 22. Specifically, the override member 24 is configured to displace the clutch coupler 20 between the nonengaged and engaged positions $C_N$, $C_E$ and to retain the clutch coupler 20 at the engaged position $C_E$ when the override member 24 is disposed at an unlock position $O_U$ (FIGS. 7, 10, 24). Thereby, the exterior door handle 14A is coupled with the retractor 16 to enable the door D to be "opened", as described below. Thus, the override mechanism 10 enables the door D to be locked and unlocked during a failure of the lock electronic components.

Figure 8:
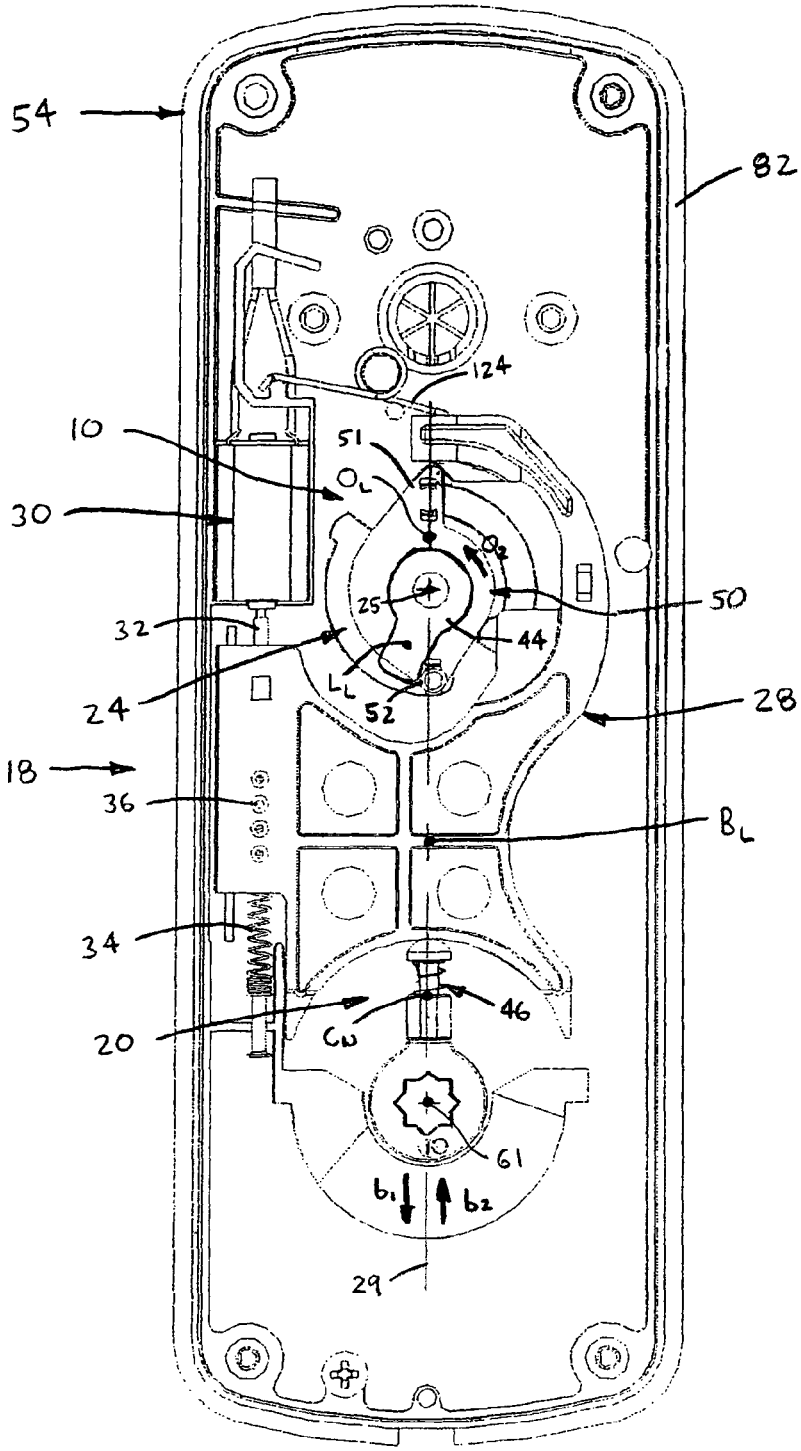
FIG. 8 is another view of the components of FIG. 6, shown with the override member in a lockout position and the actuator body in an inoperative position.
Figure 12:
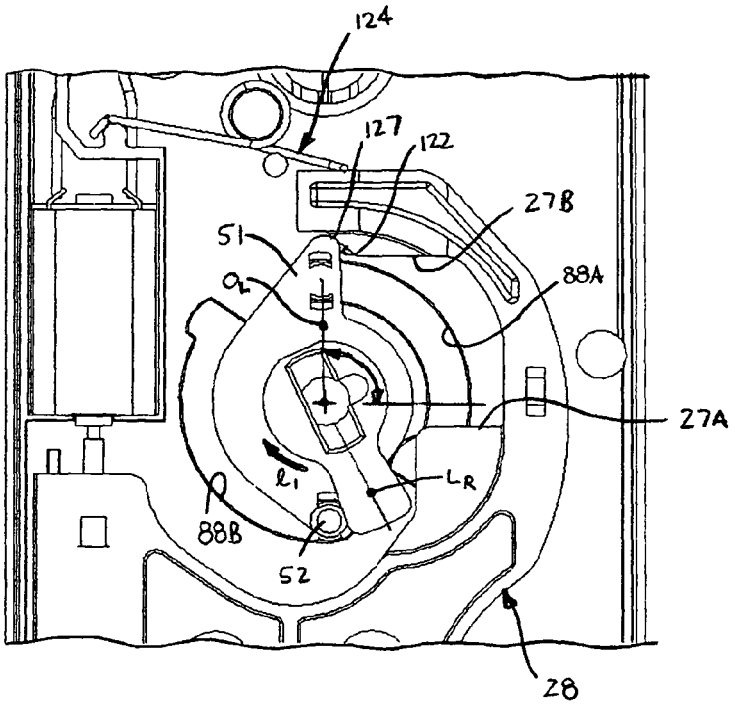
FIG. 12 is an enlarged, broken-away front plan view of the override mechanism and clutch actuator body of FIG. 9, shown with a cylinder lock cam at a release configuration.
Figure 25:
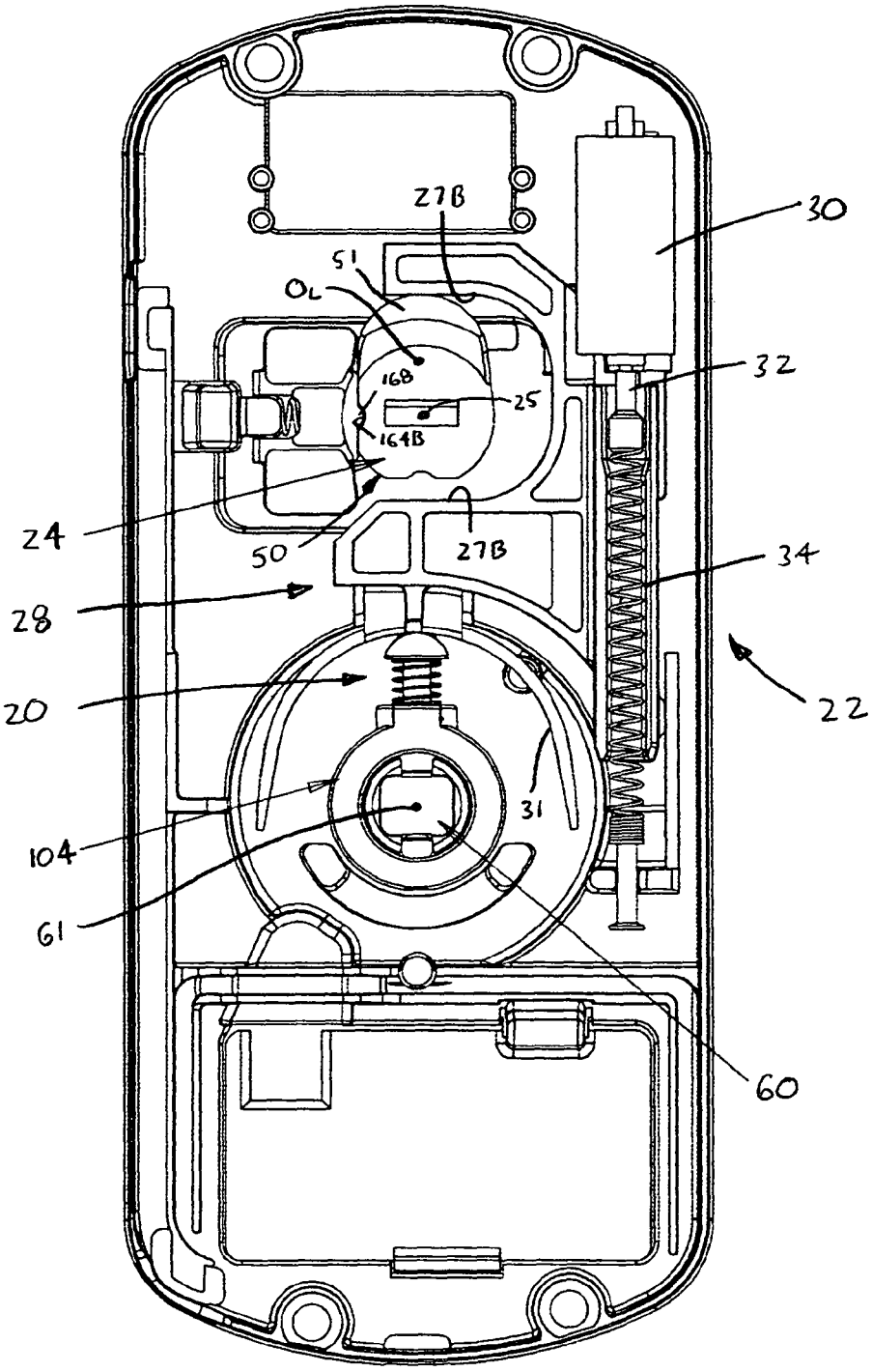
FIG. 25 is yet another view of the override mechanism and clutch actuator body of FIG. 23, shown with the override member in an a lockout position.

Preferably, the override member 24 is further configured to prevent displacement of the coupler 20 during actuator operation when the override member 24 is disposed at a lockout position $O_L$, as depicted in FIGS. 8, 12 and 25. Most preferably, the override member 24 is configured to releasably fix or secure a portion of the clutch actuator 22 when the member 24 is located at the lockout position $O_L$, such that the actuator 22 is thereby prevented from displacing the coupler 20. However, the override member 24 may alternatively be constructed so as to secure the coupler 20 itself to directly prevent movement of the coupler 20 to the engaged position $C_E$ (structure not shown). As a further alternative, the override mechanism 10 may include a separate retainer (not shown) configured to releasably engage with the actuator 22, or directly with the coupler 20, in a manner that prevents movement of the coupler 20 to the engaged position $C_E$. With any of these structures, the override mechanism 10 provides the capability of preventing the unlocking of the door D by means of the electromechanical clutch mechanism 12, as discussed in further detail below. However, the override mechanism 10 may be constructed so as to only permit manual unlocking of the door D, i.e., by manual displacement of one or more components of the clutch mechanism 18, without the capability of securing the clutch mechanism 18, the coupler 20, etc., in order to prevent the clutch mechanism 18 from displacing the coupler 20.

Referring to FIGS. 6-12, 17 and 21-25, the clutch actuator 22 preferably includes a body 28 displaceable between an initial position $B_I$, (e.g., FIG. 6) and an actuated position $B_A$ (e.g., FIG. 7), the clutch actuator body 28 being configured to displace the coupler 20 to the engaged position $C_E$ when the actuator body 28 moves toward the actuated position $B_A$. Further, the override member 24 is preferably configured to releasably engage with the clutch body 28 so as to prevent displacement of the body 28 toward the actuated position $B_A$, thereby maintaining the coupler 20 at the nonengaged position $C_N$ and the door D in a locked state, as depicted in FIGS. 8, 12 and 25. More specifically, the clutch actuator body 28 is preferably further displaceable to a "locked" or inoperative position $B_L$, located such that the initial position $B_I$, is situated generally between the inoperative and actuated positions $B_L$ and $B_A$. The override member 24 is configured to displace the clutch body 28 toward the inoperative position $B_L$, and then to releasably engage with the body 28, when the member 24 displaces to the lockout position $O_L$. Further, as shown in FIGS. 6, 9, and 23, the override member 24 is also disposeable or locatable at a neutral position $O_N$, at which the member 24 permits the clutch actuator body 28 to displace between the initial and actuated positions $B_I$, $B_A$ without interference from the override mechanism 10, as described below.

Still referring to FIGS. 6-12, 17 and 21-25, the clutch actuator body 28 is preferably linearly displaceable in opposing direction $b_1$, $b_2$ along a generally vertical axis 29 between the uppermost, inoperative position $B_L$ and the lowermost, actuated position $B_A$, the initial position B, being located generally therebetween. Alternatively, the clutch actuator 22 may be constructed such that the actuator body 28 is displaceable along an axis that is horizontal or skewed, the relative positions $B_L$, $B_A$ may be reversed such that the actuated position $B_A$ is located generally vertically above or "higher than" the other body positions $B_I$, $B_L$, or/and the body 28 may be rotatably displaceable about an axis (no alternatives shown). Further, the override member 24 is preferably angularly displaceable (i.e., rotatable or pivotable) about a central axis 25 between the respective unlock, neutral, and lockout positions $O_U$, $O_N$, $O_L$, and is most preferably constructed as a cam 50 as described below. As such, the override member 24 contacts and drives the actuator body 28 in the opposing linear directions $b_1$, $b_2$ along the axis 29 as the body 28 pivots/rotates about the axis 25. More specifically, the override member 24 displaces the actuator body 28 in the first, downward direction $b_1$, along the axis 29 when the override member 24 rotates in a first angular direction $o_1$, as indicated in FIG. 7. Alternatively, the override member 24 displaces the actuator body 28 in the second, upward direction $b_2$ along the axis 29 when the member 24 rotates in a second angular direction $o_2$, as indicated in FIG. 8. Furthermore, the clutch body 28 preferably includes a pair of facing contact surfaces 27A, 27B contactable by the preferred override cam 50 and an arcuate engagement surface 31 contactable with the preferred coupler 20, as described in detail below.

Figure 5:
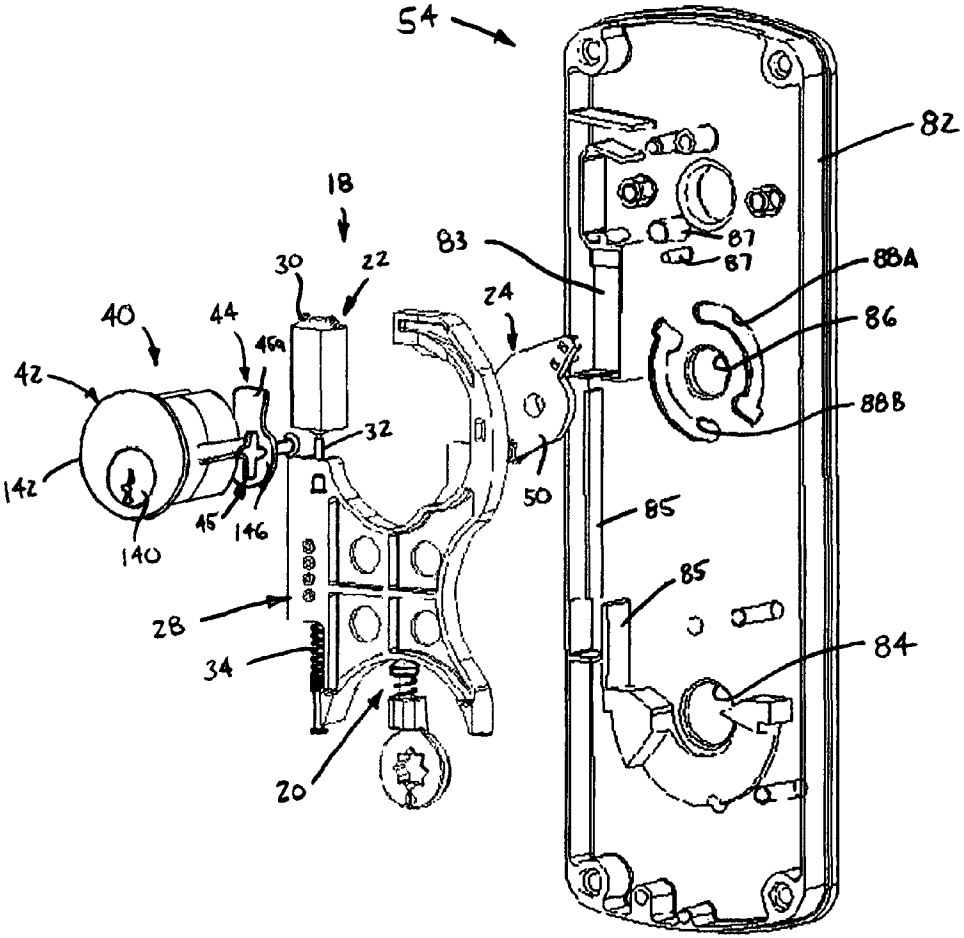
FIG. 5 is an exploded view of the override member and the lock clutch mechanism.
Figure 6:
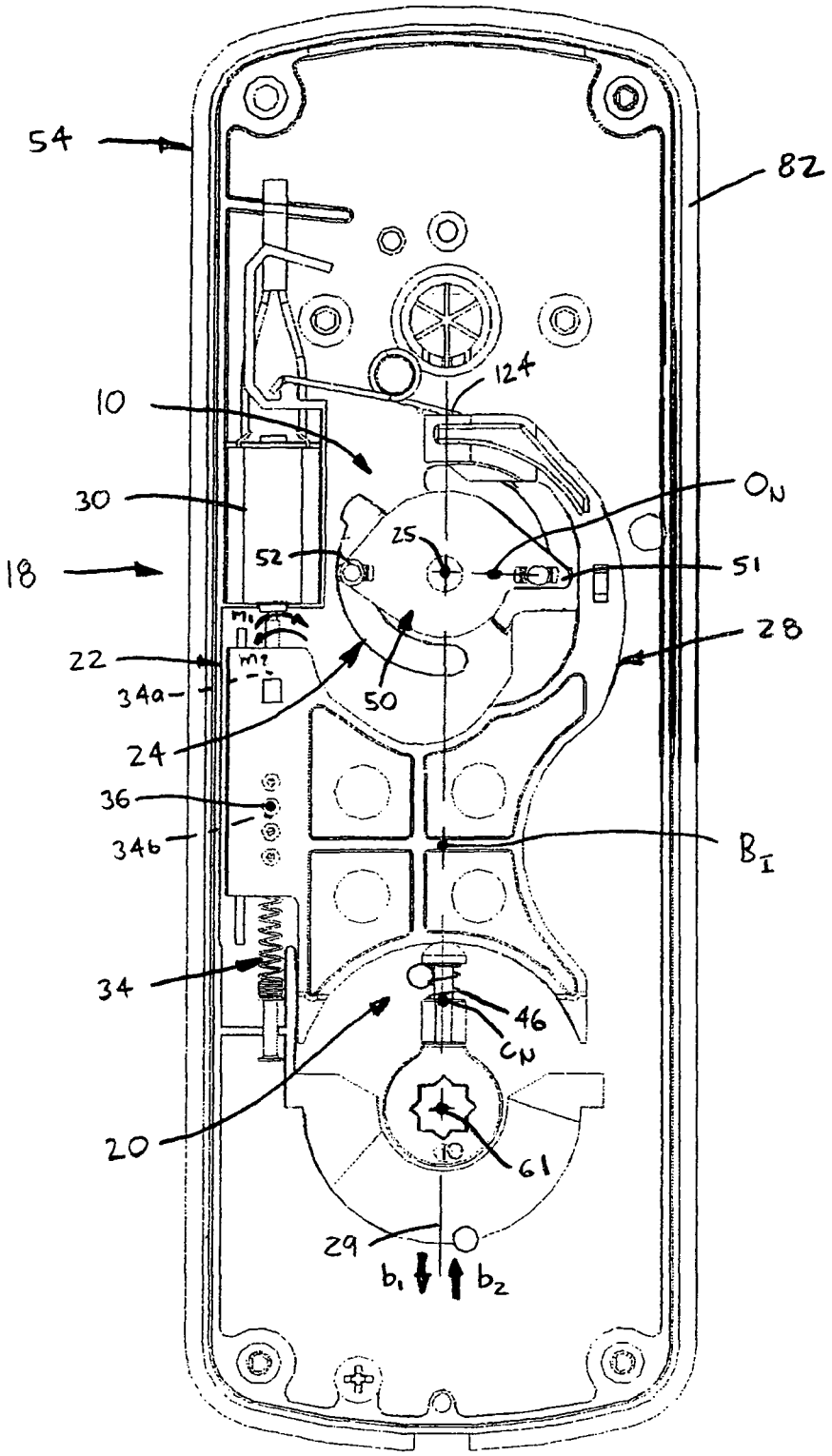
FIG. 6 is a front plan view of the override mechanism and clutch mechanism, shown with the override member in a neutral position, with an actuator body in an initial position, and without a lock cylinder drive.
Figure 7:
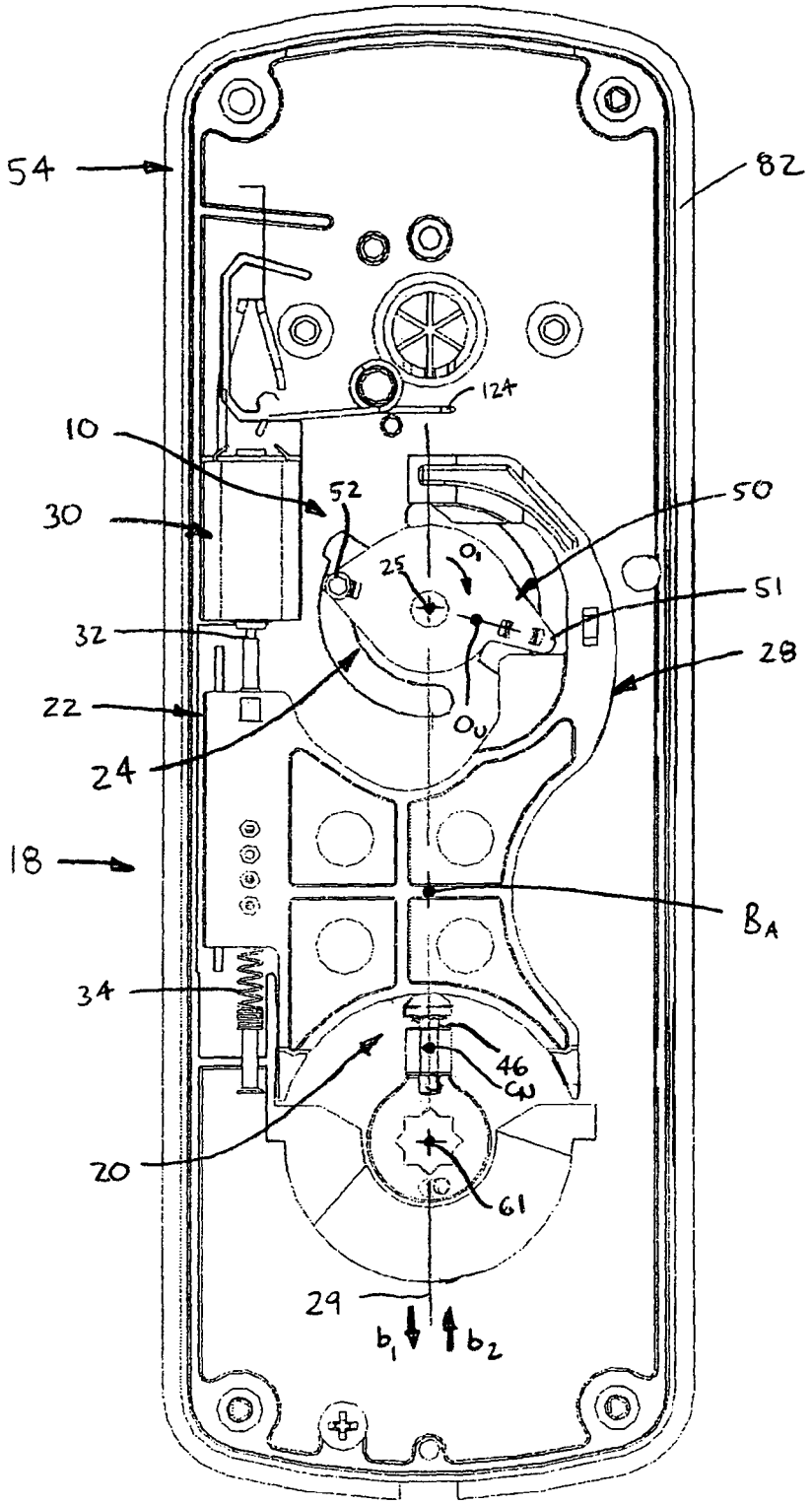
FIG. 7 is another view of the components of FIG. 6, shown with the override member in an unlock position and the actuator body in an actuated position.
Figure 21:
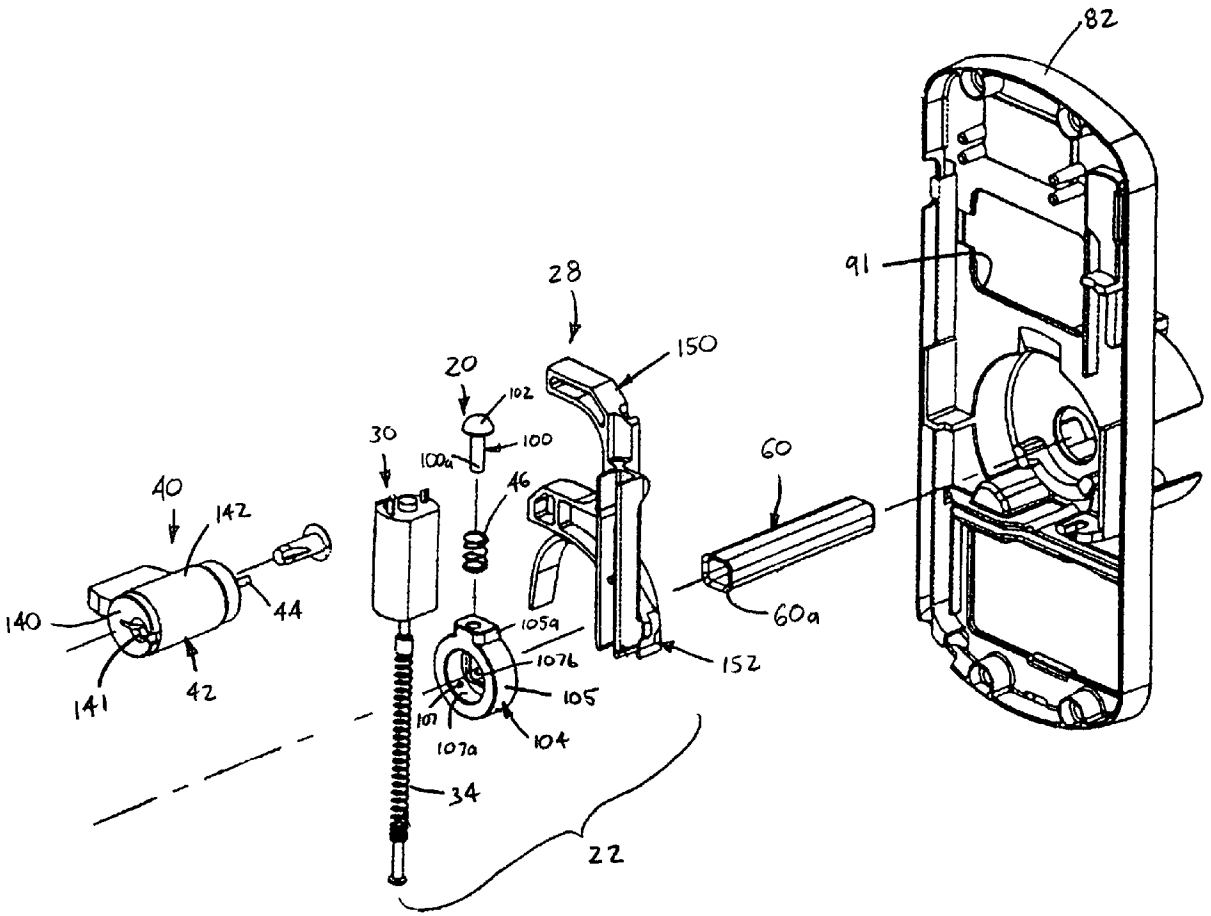
FIG. 21 is an enlarged view of a portion of FIG. 20.
Figure 22:
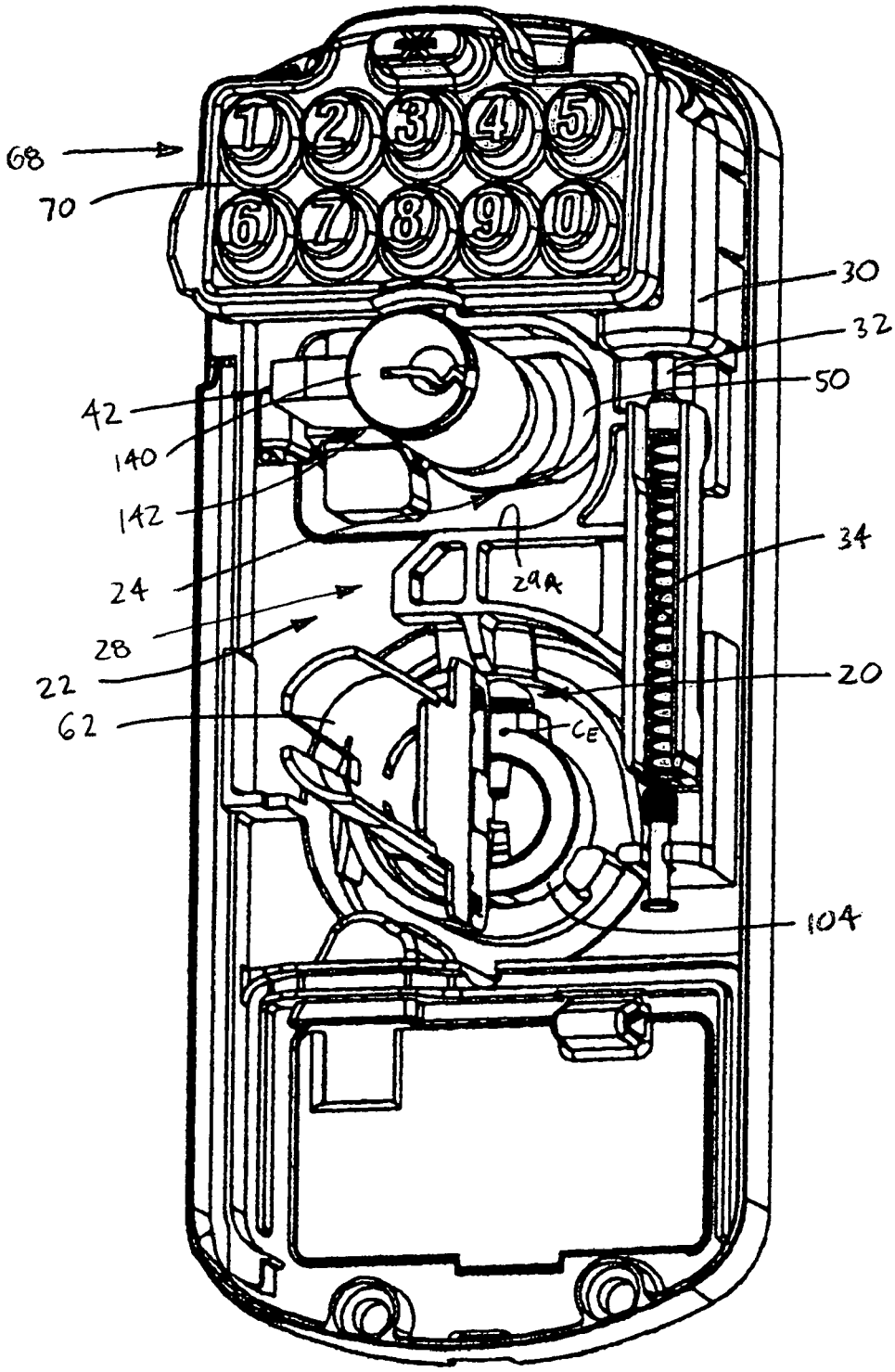
FIG. 22 is a front perspective view of the second construction of the lock assembly and override mechanism, shown without a housing shell and with an outer spindle partly broken-away.
Figure 23:
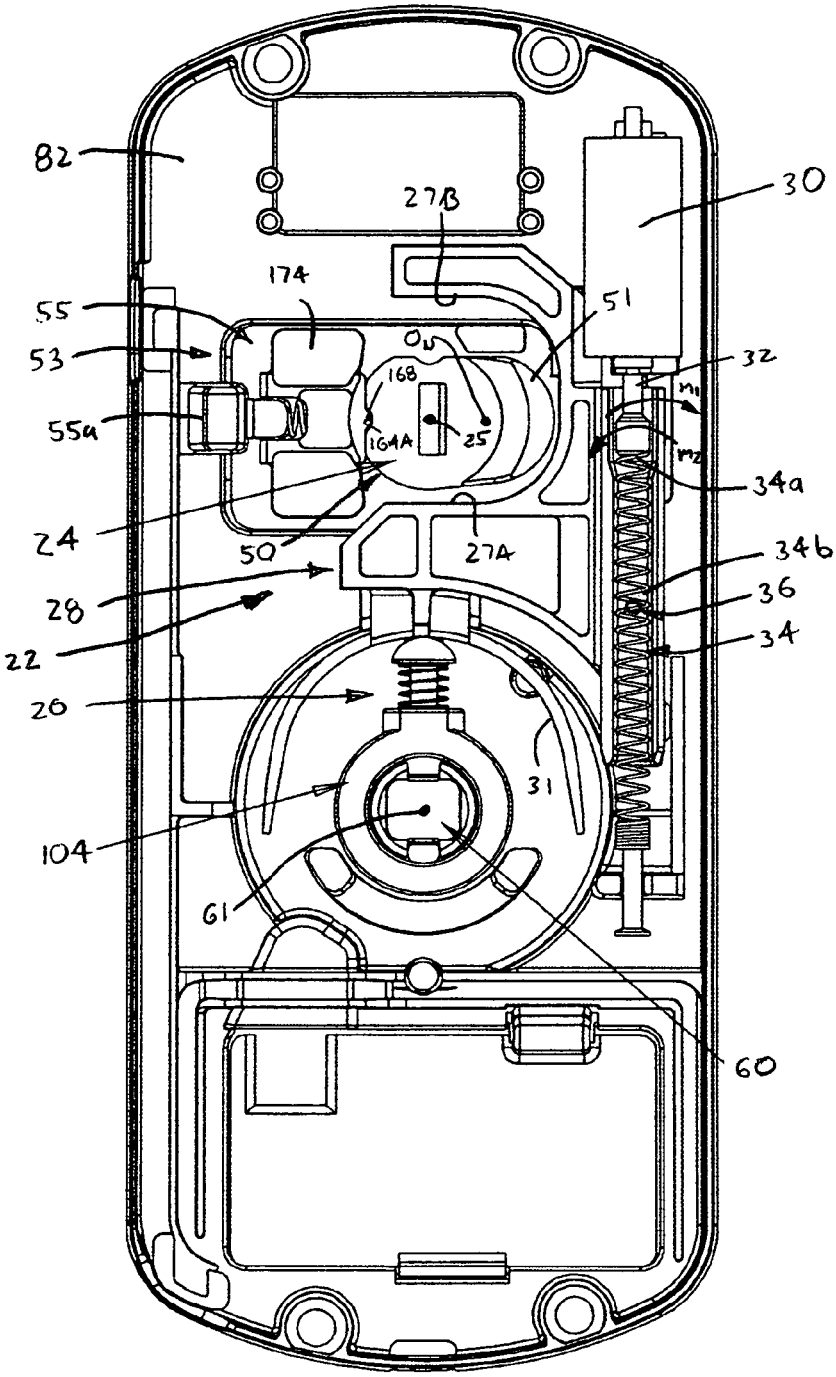
FIG. 23 is a front plan view of the override mechanism and clutch mechanism, shown with the override member in a neutral position, an actuator body in an initial position, and without a lock cylinder drive.
Figure 24:
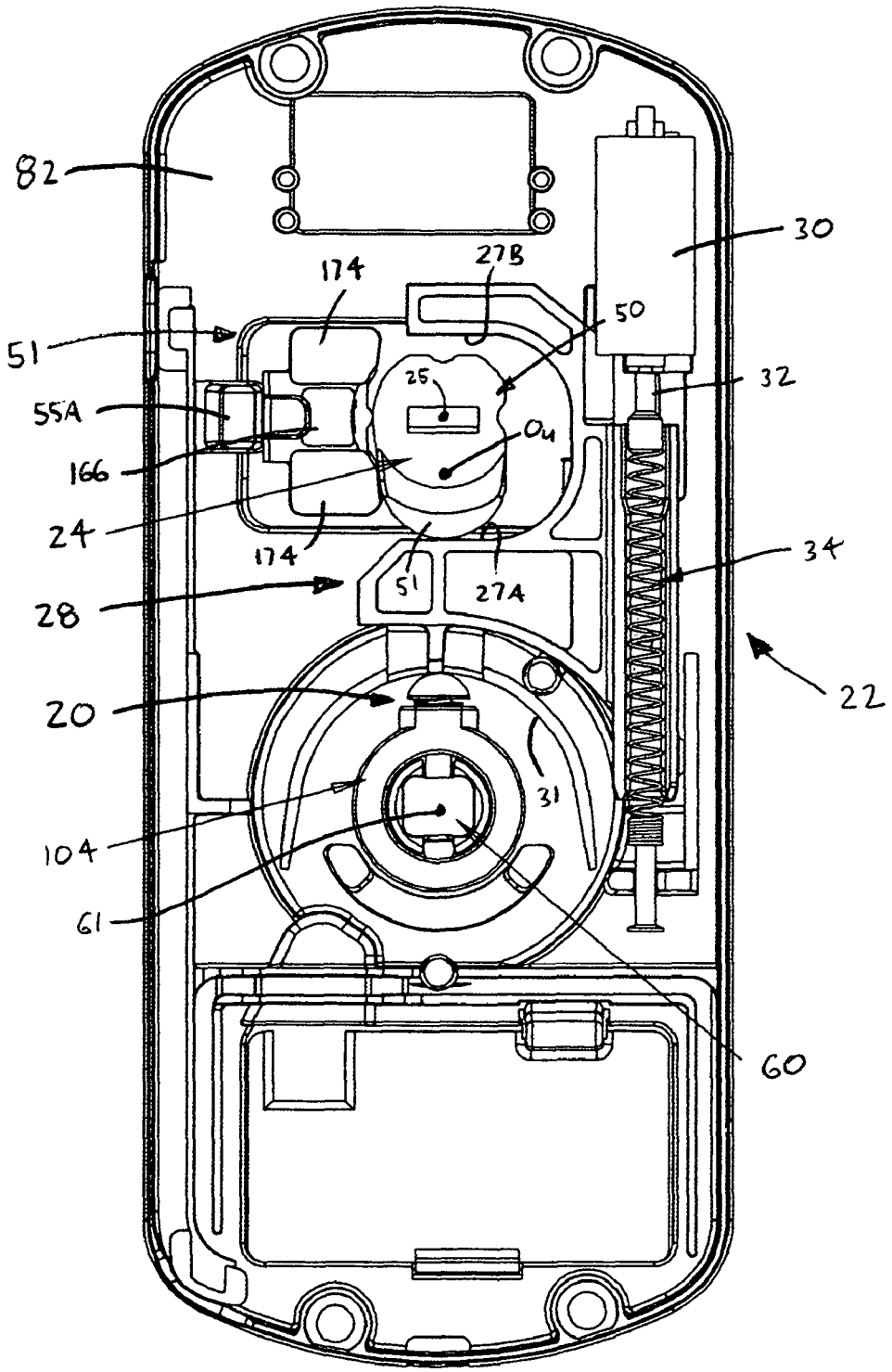
FIG. 24 is another view of the override mechanism and clutch actuator body of FIG. 23, shown with the override member in an unlock position.

As best shown in FIGS. 4-8 and 20-23, the clutch actuator 22 preferably further includes a motor 30 with a shaft 32 rotatable in opposing directions $m_1$, $m_2$, as indicated in FIGS. 6 and 23. The motor shaft 32 is operatively coupled with the actuator body 28 such that rotation of the shaft 32 in a first direction $m_1$ displaces the body 28 toward the actuated position $B_A$ and rotation of the shaft 32 in a second direction $m_2$ displaces the body 28 generally away from the actuated position $B_A$, preferably to the initial position $B_I$. With such an actuator structure, the override member 24 is configured to retain the actuator body 28 substantially immovable during motor shaft rotation when the member 24 is disposed at the lockout position $O_L$, as described in further detail below. Preferably, the clutch actuator 22 includes a spring shaft 34 having a first end 34*a* connected with the motor 30 (i.e., to the shaft 32) and a second end 34*b* coupled with the clutch body 28, preferably by a coupler pin 36 attached to the body 28 and disposed between the coils of the shaft 34, as indicated in FIGS. 6 and 23. As such, the spring shaft 34 permits the motor 30 to rotate while the override member 24 secures the clutch body 28 in a generally fixed position, as described below, so as to prevent damage to the motor 30.

Referring now to FIGS. 1, 3-5, 9-12, 18 and 20-22, the override mechanism 10 preferably further comprises a manual drive 40 configured to displace the override member 24 between the unlock position $O_U$ and the lockout position $O_L$, specifically from the neutral position $O_N$ to either functional position $O_U$, $O_L$. As mentioned above, the override member 24 is preferably angularly displaceable about the axis 25 between the unlock and lockout positions $O_U$, $O_L$. With this override member structure, the manual drive 40 preferably includes a rotatable cylinder lock 42 configured to angularly displace the override member 24 about the override axis 25. The cylinder lock 42 preferably includes an output member 44 engageable with, or connected to, the override member 24 to displace the member 24 about the axis 25. Further, the cylinder lock 42 is preferably adjustable from an initial configuration $L_I$ (FIGS. 1, 4, 18 and 22) to an unlock configuration $L_U$ (FIG. 10), the lock output member 44 displacing the override member 24 to the unlock position $O_U$ as the cylinder lock 42 adjusts to the unlock configuration $L_U$. The cylinder lock 42 is also adjustable from the initial configuration $L_I$ to a lockout configuration $L_L$ (see FIG. 8), the output member 44 displacing the override member 28 to the lockout position $O_L$ as the cylinder lock 42 adjusts to the lockout configuration $L_O$. Furthermore, as shown in FIG. 12, the cylinder lock 42 is preferably further adjustable to a release configuration $L_R$, at which the output member 44 drives the override member 24 to disengage from the clutch actuator body 28, as described above and in further detail below.

Figure 13:
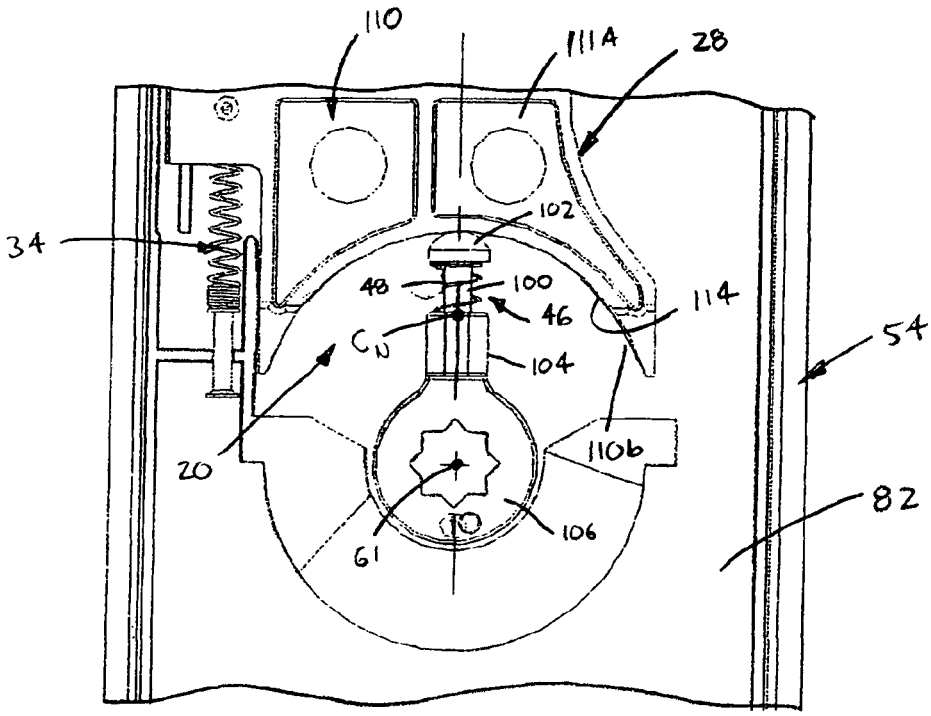
FIG. 13 is an enlarged, broken away front plan view of the clutch mechanism of FIG. 6, showing a clutch coupler in a nonengaged position.
Figure 14:
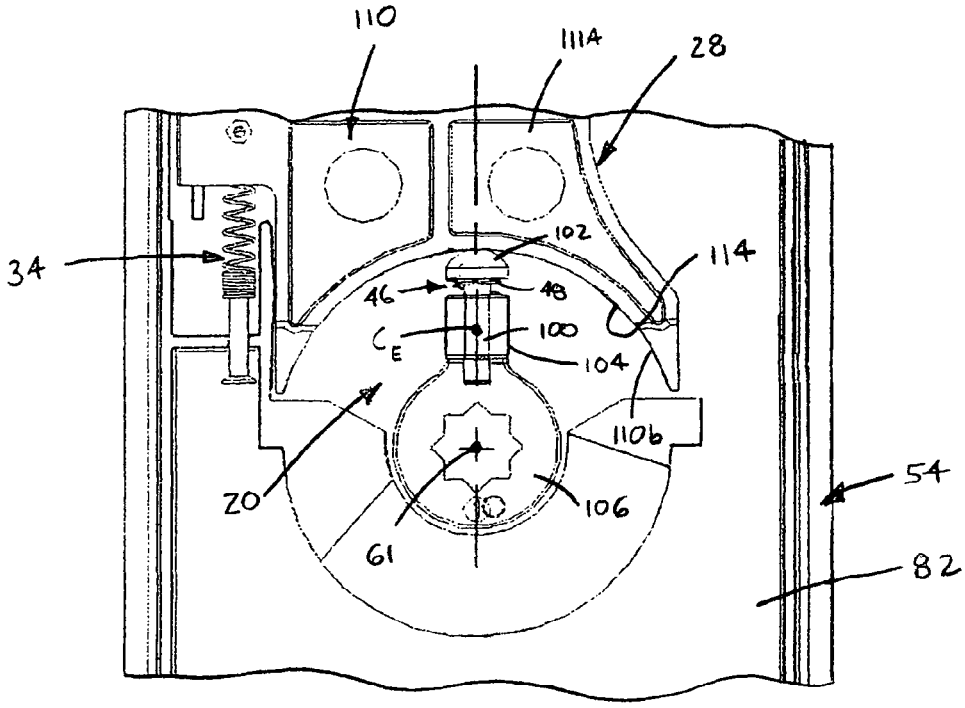
FIG. 14 is another view of the components of FIG. 13, shown with the coupler at an engaged position.
Figure 15:
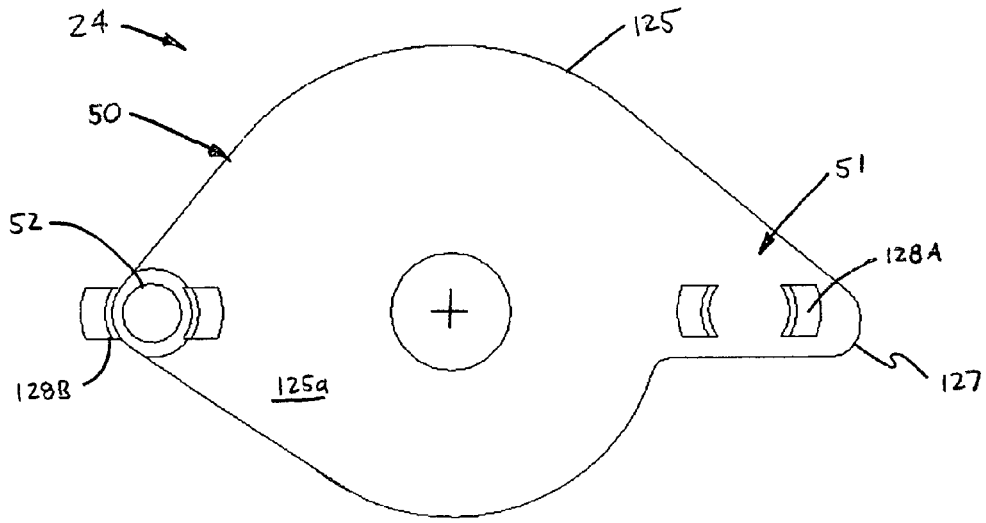
FIG. 15 is a front plan view of the override member.

As best shown in FIGS. 13, 14 and 21, the lock assembly 12 preferably additionally includes a biasing member 46 configured to bias the coupler 20 to the nonengaged position $C_E$, which is preferably a coil spring 48 as described below. As such, the override member 24 is configured to retain the coupler 20 in the engaged position $C_E$ against the action of biasing member 46 when a user manually retains the cylinder lock 42 in the unlock configuration $L_U$. In other words, when the user rotates the lock 42 to move the override member 24 to the unlock position $O_U$, the biasing member 46 becomes compressed as the override member 24 (preferably through the clutch body 28) moves the clutch coupler 20 to the engaged position $C_E$. Thus, the user must hold the lock 42 in the unlock configuration $L_U$ until the handle 14A is rotated to retract the latch 15. Thereafter, the biased coupler 20 displaces the override member 24, through the actuator body 28, from the unlock position $O_U$ when the user releases the cylinder lock 42 from the unlock configuration $L_U$, returning the override member 24 to the neutral position $O_N$ while the member 24 displaces the cylinder lock 42 back to the lock initial configuration $L_I$.

Referring now to FIGS. 5, 9-12, 15, 16 and 23-27, the override member 24 preferably includes a rotatable cam 50 engageable with the clutch actuator 22, preferably with the actuator body 28, as discussed above, and has a pusher section 51 separately contactable with a pair of contact surfaces 27A, 27B of the clutch actuator body 28, as described in further detail below. In a first preferred construction shown in FIGS. 5, 9-12, 15 and 16, the override cam 50 is preferably rotatably mounted to a base 54 of the lock assembly 12 and the override member 24 further includes a drivable post 52 extending from the cam 50. The cam post 52 is engageable by the lock output member 44, which is preferably formed as a generally circular cam plate 45 having a rectangular drive portion 45*a* contactable with the post 52. With this construction, rotation of the cylinder lock 42 in a first direction $l_1$ drives the cam 50 to rotate or pivot in the first direction $o_1$, to thereby displace the clutch actuator body 28 generally toward the body actuated position $B_A$ and/or generally away from the body inoperative position $B_L$. Alternatively, rotation of the lock 42 in a second direction $l_2$ drives the cam 50 to rotate/pivot in the second direction $o_2$, thereby moving, or permitting movement of, the actuator body 28 generally away from the body actuated position $B_A$ and toward the body inoperative position $B_{IO}$.

In the second preferred construction depicted in FIGS. 23-27, the override member cam 50 is mounted to an override base assembly 53 that further includes a base 55 connectable with the lock assembly base 54, the cam 50 being rotatably mounted to the base 55. The override assembly 53 further includes a spring-biased retainer 57 configured to separately retain the cam 50 in neutral position $O_N$ and the lockout position $O_L$, as described in detail below. The override member cam 50 has a central opening 50*a* sized to receive the lock output member 44, which is shaped as a generally rectangular prong, such that rotation of the output member 44 rotates the override member 24, as described in further detail below. With the preferred cylinder lock drive 40, the rotation of the cylinder lock 42 in the first direction $l_1$ drives the cam 50 to rotate/pivot in the first direction $o_1$, thereby displacing the clutch actuator body 28 generally toward the body actuated position $B_A$ and/or generally away from the body inoperative position $B_L$. Alternatively, rotation of the drive lock 42 in the second direction $l_2$ drives the cam 50 to rotate/pivot in the second direction $o_2$, thereby moving, or permitting movement of, the actuator body 28 generally away from the body actuated position $B_A$ and toward the body inoperative position $B_{IO}$, and thus functions in a substantially similarly manner as the first cam construction.

Although a rotatable/pivotable cam 50 is preferred, the override member 24 may alternatively be constructed so as to be linearly displaceable between at least the three member positions $O_U$, $O_N$, $O_L$. For example, the override member 24 may be constructed as a lockable slide member (not shown) having a portion contactable or engageable with the clutch body 28 or even the coupler 20, such that the linear motion of the override slide member linearly displaces the clutch body 28, or the coupler 20 directly, to alternatively engage and disengage the coupler 20 with the exterior handle 14A. As a further alternative, the override member 24 may be engageable or contactable with the clutch actuator body 28 or the coupler 20 by means of one or more intermediate drive members (none show). For example, the override member 24 may be constructed as a rotatable pinion gear that drives a rack member (or a component connected thereto) to alternatively connect or disconnect with the clutch body 28 or the coupler 20, or may be provided by a drive link of a linkage that is appropriately constructed to displace the clutch body 28 or the coupler 20 (neither alternative shown). The scope of the present invention encompasses these and all other constructions of the override member 24 that is capable of at least displacing the coupler 20 between the engaged and nonengaged positions $C_E$, $C_N$, and preferably also to displace a portion of the clutch mechanism 18 to an inoperative position, as generally described herein.

Referring now to FIGS. 1-3 and 18-20, the override mechanism 10 of the present invention is preferably used with a lock assembly 12 having inner and outer subassemblies 13A, 13B (FIGS. 2 and 19) and further including an inner spindle 60 and an outer spindle 62, the two spindles 60, 62 being rotatable about a lock centerline 61. The inner spindle 60 is coupled with the retractor 16, preferably by means of an actuator bar 64, and the outer spindle 62 is coupled with the exterior handle 14A, the handle 14A being preferably directly mounted thereto, but may be integrally formed with the spindle 60. The coupler 20 and the biasing member 46 are connected with one of the inner and outer spindles 60, 62, preferably the inner spindle 60, and the coupler 20 is releasably engageable with the other one of the two spindles 60, 62, preferably the outer spindle 62. As such, when the coupler 20 is disposed in the engaged position $C_E$, rotation of the outer spindle 62, i.e., by rotating the exterior handle 14A, rotatably displaces the inner spindle 60 to operate the retractor 16. Further, the exterior handle 14A is preferably formed as a lever and is attached to the outer spindle 62, but may be formed as a knob or have any other appropriate shape. Although the above-described structure of the lock assembly 12 is presently preferred, the override mechanism 10 of the present invention may be used with any other lock assembly 12 having any appropriate structure, the override mechanism 10 being adaptable to accommodate the specific lock structure, such that the present invention is in no manner limited by the lock assembly structure.

Further, the lock assembly 12 also preferably includes a controller 66 (indicated in FIGS. 4 and 22) operatively coupled with the clutch actuator motor 30 and an input device 68, preferably a keypad 70, coupled with the controller 66. The controller 66 has a memory containing one or more stored lock codes and compares input from the keypad 70 with the stored codes. When an input matches a stored code, the controller 66 sends a control signal to the actuator motor 30 so that the motor 30 rotates in the first direction $m_1$ to displace the clutch body 20 to the actuated position $B_A$, thereby pushing the coupler 20 to the engagement position $C_E$ to thereby couple the inner and outer spindles 60, 62. Thereafter, the controller 66 preferably sends a second control signal to the motor 30 after a predetermined period of time, such that the motor 30 rotates the shaft 32 in the second direction $m_2$ to displace the clutch body 28 to the initial position $B_I$, thereby enabling the biasing member 46 to displace the coupler 20 to the nonengaged position $C_N$. Thereby, the lock spindles 60, 62 are uncoupled, such that rotation of the exterior handle 14A will merely rotate the outer spindle 62 without operating the retractor 14. Alternatively, the controller 66 may be configured (i.e., programmed) such that the clutch body 28 remains in the actuated position $B_A$, and thus the door D remains unlocked, until the controller 66 receives an authorized input to initiate displacement of the clutch body 28 back to the initial position.

With the above-described structure, the override mechanism 10 of the present invention functions basically as follows. In ordinary use of the electronic lock assembly 12, a user generally opens the door D by entering a code in a preferred keypad 70 to operate the motor 30, such that the clutch body 28 displaces the coupler 20 to the engaged position $C_E$, as described above. However, in the event of a failure of any of the electrical components (e.g., the controller 66, keypad 70, motor 30, etc.), the override member 24 may be manually displaced to the unlock position $O_U$, preferably by means of the cylinder lock 42, to thereby move the coupler 20 to the engaged position $C_E$ and enable the door D to be opened. Further, if a user, such as a homeowner, wishes to disable the electronic actuator 22 in order to prevent someone from using an authorized code to unlock the associated door D, the user may displace the override member 24 toward the lockout position $O_L$, thus moving the clutch actuator body 28 to the inoperative position $B_L$ and releasably locking the actuator body 28 thereat. Thereafter, until the override member 24 is again displaced toward the neutral position $O_N$ or/and unlock position $O_U$, by moving the drive cylinder lock 42 back toward the unlock configuration $L_U$, and preferably to a release configuration $L_R$, the clutch actuator body 28 remains secured at the inoperative position $B_L$, and entry of an authorized code into the controller 66 will only cause the motor 30 to rotate without displacing the actuator body 28.

Having described the basic elements and functions above, these and other components of the override mechanism 10 of the present invention are described in further detail below.

Referring to FIGS. 1-4 and 18-20, the override mechanism 10 is preferably used with a lock assembly 12 that includes a housing 76 mountable to the door D. The housing 76 provides the base 54 and further includes an outer shell 78 connected with the base 54 so as to define an interior chamber 80. The base 54 is preferably formed as a generally rectangular plate 82 attachable to the exterior surface $S_E$ of the door D. The base plate 82 preferably includes a circular spindle bearing hole 84 sized to receive the lock inner spindle 60 and a mounting surface 83 onto which is disposed the actuator motor 30, a plurality of guide walls 85 formed to guide the displacement of clutch actuator body 28, and a pair of spring-mounting pegs 87 for attaching a preferred clutch body biasing member 124 to the base 54, as described below. With the first override mechanism construction, the base plate 82 includes a circular override member bearing hole 86 configured to receive a portion of the override member cam 50, as described below, and a pair of arcuate guide slots 88A, 88B spaced circumferentially about the override member bearing hole 86, as best shown in FIG. 5. The guide slots 88A, 88B are each configured to receive a separate guide peg 128A, 128B, respectively, attached to the override member cam 50, as discussed in further detail below, and the upper guide slot 88A has an end surface section providing an override stop surface 89, as described in greater detail below.

In the second construction override mechanism, the base plate 82 has a relatively large, generally rectangular hole 91 sized to receive the override base assembly 51, the base 55 having a clip portion 55*a* engageable with the base plate 82 when disposed in the hole 91 (FIG. 20) so as to releasably connect the override base assembly 51 with the housing 76. Furthermore, in both constructions, the housing shell 78 is preferably generally rectangular and has an outer spindle bearing hole 90 configured to receive the outer spindle 62, a cylinder lock bearing hole 92 configured to receive the cylinder lock 42, and a keypad clearance hole 94. With the above structure, the clutch coupler 20, the clutch actuator 22, the override member 24, and related components are contained within the housing interior chamber 80, while the inner spindle 60 extends through the base plate 82 and the cylinder lock 42 and outer spindle 62 each extend through the housing shell 78.

Figure 20:
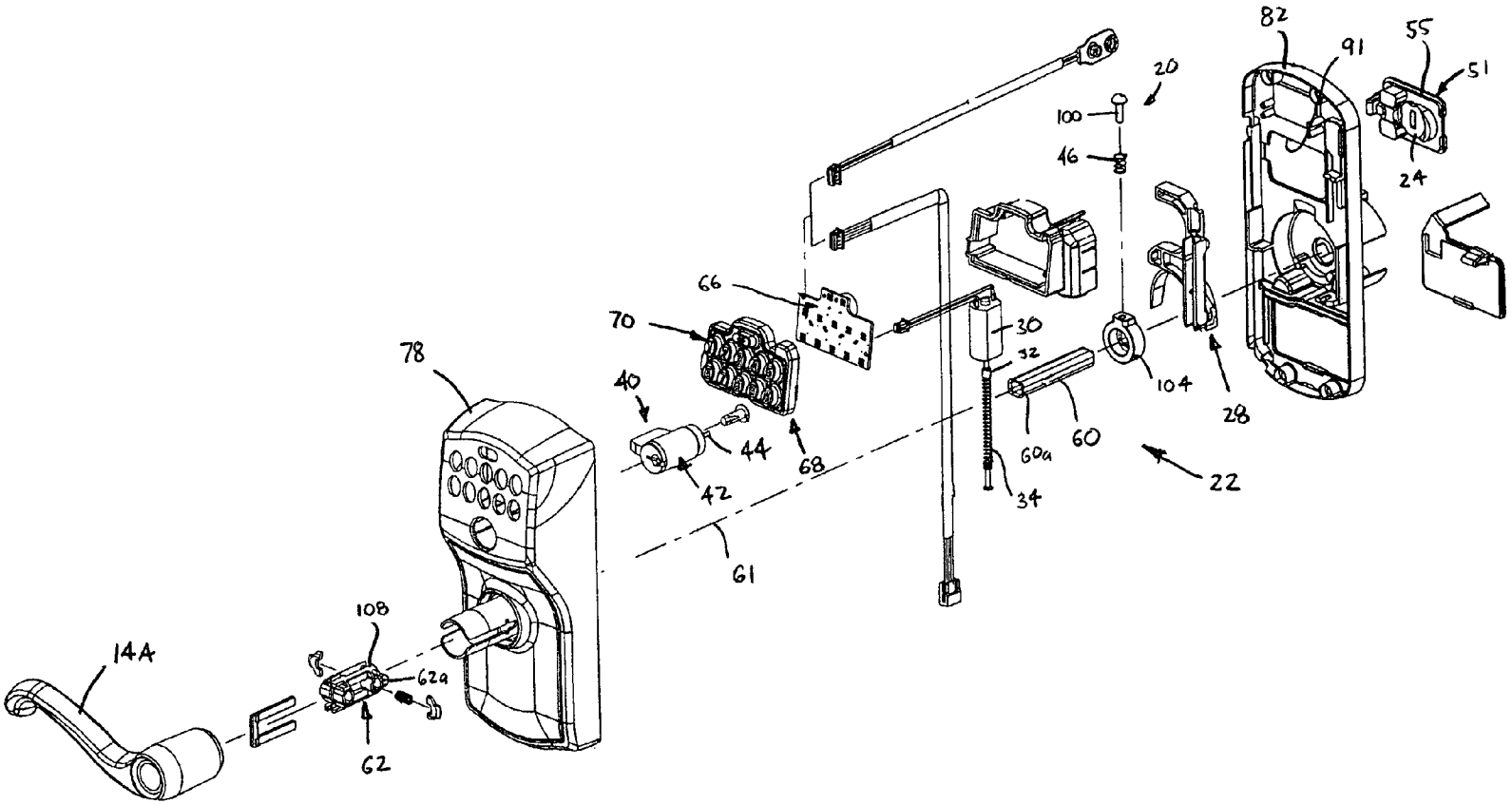
FIG. 20 is an exploded view of the lock assembly of FIG. 19.

Referring now to FIGS. 5-8, 13, 14 and 20-22, the clutch coupler 20 preferably includes a generally cylindrical pin 100 having a head 102 and is slideably disposed in a base 104 connected with the inner spindle 61. The outer spindle 62 preferably has a plurality of notches 108 formed in the inner end 62*a* thereof, the coupler pin 100 having an lower end 100*a* disposeable in one of the notches 108 when the coupler 20 is located at the engaged position $C_E$. Further, the biasing member coil spring 48 is disposed about the coupler pin 100 so as to extend between the pin head 102 and the 104, so as to bias the pin end 100*a* generally away from the lock centerline 61. In the lock first construction, the coupler base 104 is preferably provided by a generally rectangular block 103 attached to a circular base plate 106, the plate 106 being attached to the inner axial end 60*a* of the inner spindle 60, as shown in FIGS. 5-8, 13 and 14. As shown in FIGS. 20-22, in the second construction of the lock assembly 12, the base 104 includes a generally annular body 105 having a central axial bore 107 and a flat portion 105*a* with a radial hole 109 configured to receive the coupler pin 100. The base bore 107 has a first section 107*a* configured to receive the outer spindle inner axial end 62*a*, such that the spindle end 62*a* is slidably rotatable within the base body 105 when the coupler 20 is nonengaged, and a second section 107*b* configured to fixedly receive the inner spindle inner end 60*a* such that the coupler base 104 and inner spindle 60 always rotate together once assembled.

Referring to FIGS. 5-14 and 18, in the first construction lock assembly 12, the clutch actuator body 28 is preferably formed as a complex-shaped block 110 having generally parallel front and rear faces 111A, 111B, a generally C-shaped bar portion 112 extending from a body upper end 110*a* and a curved lower end 110*b* providing the arcuate engagement surface 31. A generally rectangular block portion 116 of the block 110 has a pair of aligned notches 117 providing clearance for the motor shaft 32 and the spring shaft 34, and at least one and preferably a plurality of mounting holes 118 each configured to receive an end of the spring shaft drive pin 36. Further, the body bar portion 112 defines a cam-receiving opening 113 and has spaced-apart, facing first and second surfaces 120A, 120B providing the body contact surfaces 27A, 27B contactable by the override member 24, as discussed above and in further detail below. Also, the bar portion 112 further has a retention surface 122 facing generally toward the body lower end 110*b*, and thus toward the coupler 20, which is lockingly engageable by the override member 24, as discussed in further detail below. Furthermore, as discussed above, the clutch actuator body 28 is linearly displaceable in opposing directions $b_1$, $b_2$ generally along a vertical axis 29, so as to displace the engagement surface 114 respectively against and away from the preferred coupler pin head 102, to thereby displace the coupler between the nonengaged and engaged positions $C_N$, $C_E$. As best shown in FIG. 12, the first construction of the lock assembly 12 preferably further includes a clutch body biasing member 124, most preferably a torsion spring, contactable with an upper surface of the clutch body bar portion 112 and configured to bias the clutch actuator body 28 in the downward direction $b_1$, for reasons described below.

Figure 28:
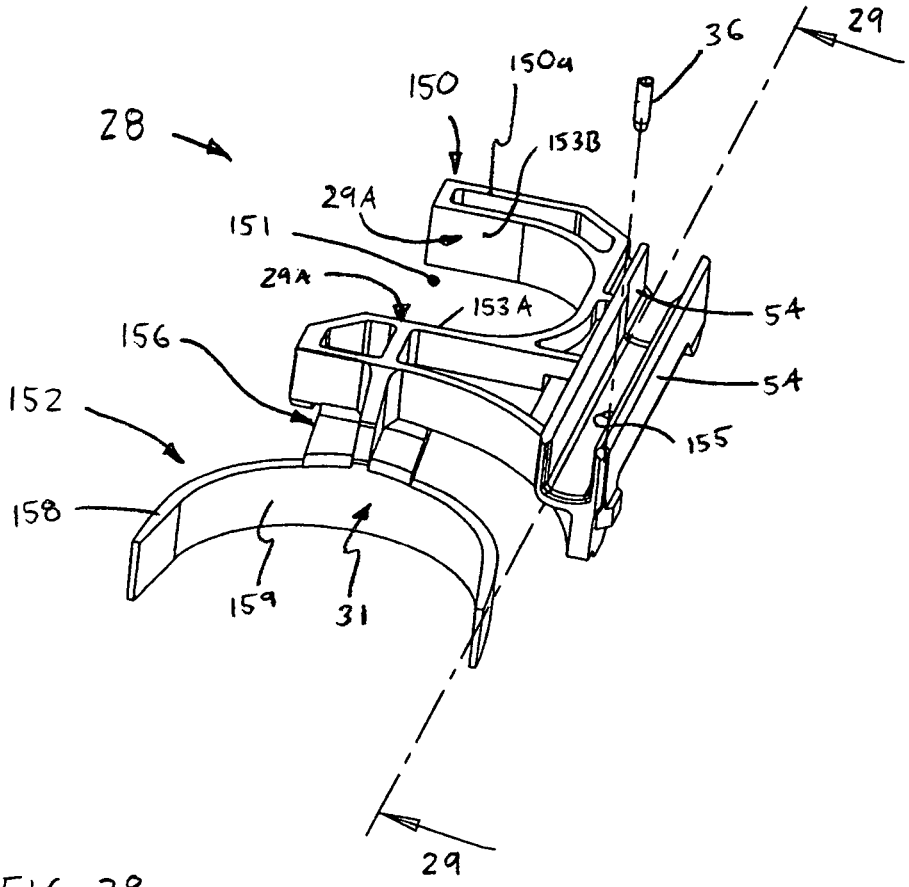
FIG. 28 is a front perspective view of the second construction clutch actuator modified for use with the second construction override mechanism.
Figure 29:
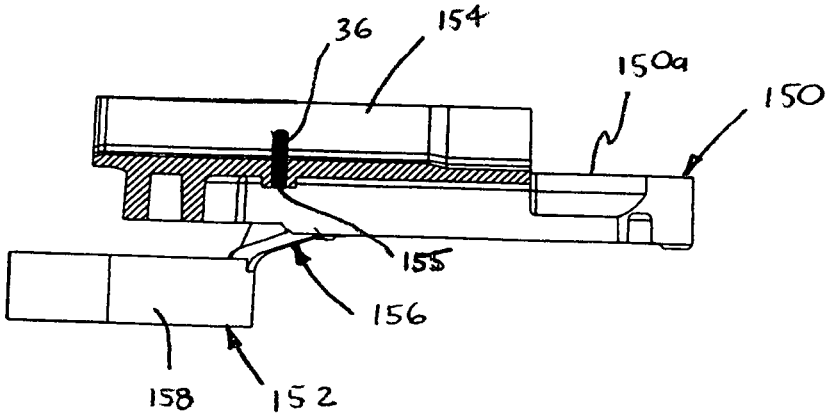
FIG. 29 is a cross-sectional view of the second construction actuator body through line 29-29 of FIG. 28.

Referring to FIGS. 28 and 29, the clutch actuator body 28 of the second construction of the lock assembly 12 preferably includes a first, upper C-shaped body portion 150 providing the clutch contact surfaces 27A, 27B and a lower C-shaped body 152 providing the arcuate engagement surface 31. The clutch body upper portion 150 has a cam-receiving opening 151 and has spaced-apart, facing first and second surfaces 153A, 153B providing the body contact surfaces 27A, 27B contactable by the override member 24, as discussed above and in further detail below. A pair of spaced-apart, generally vertically-extending rails 154 extend from a front surface 150*a* of the body upper portion 150 and are configured to receive a portion of the spring shaft 32. Further, a mounting hole 155 is located on the body portion 150 generally between the rails 155, the mounting hole 155 being configured to receive an end of the spring shaft drive pin 36. Furthermore, the clutch body lower portion 152 is preferably formed as a generally semi-circular bar 158 having a concave inner surface 159 providing the coupler engagement surface 31 and is spaced generally rearwardly from the upper body portion 150. The upper and lower body portions 150, 152 of the clutch body 28 are connected, preferably integrally connected, by a connective body portion 156 extending between the two body portions 150, 152.

Figure 16:
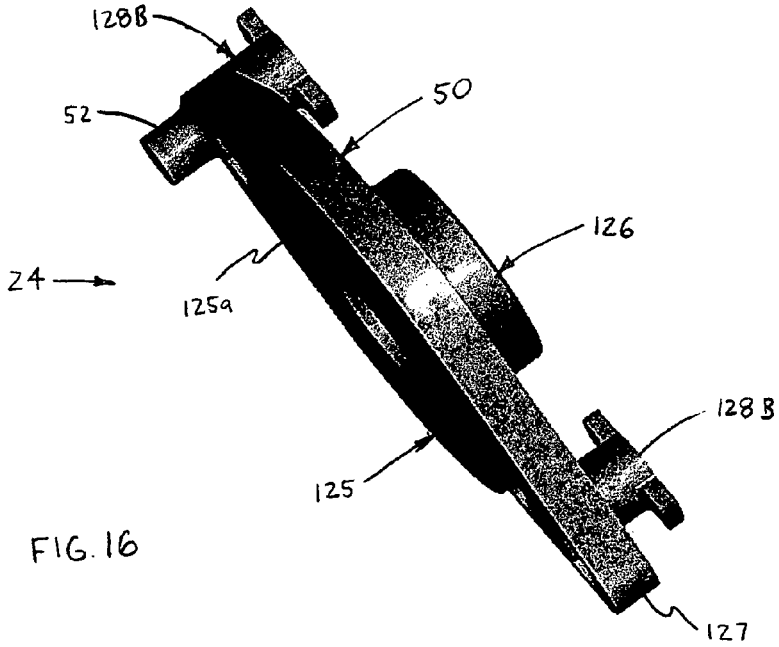
FIG. 16 is a side perspective view of the override member.
Figure 17:
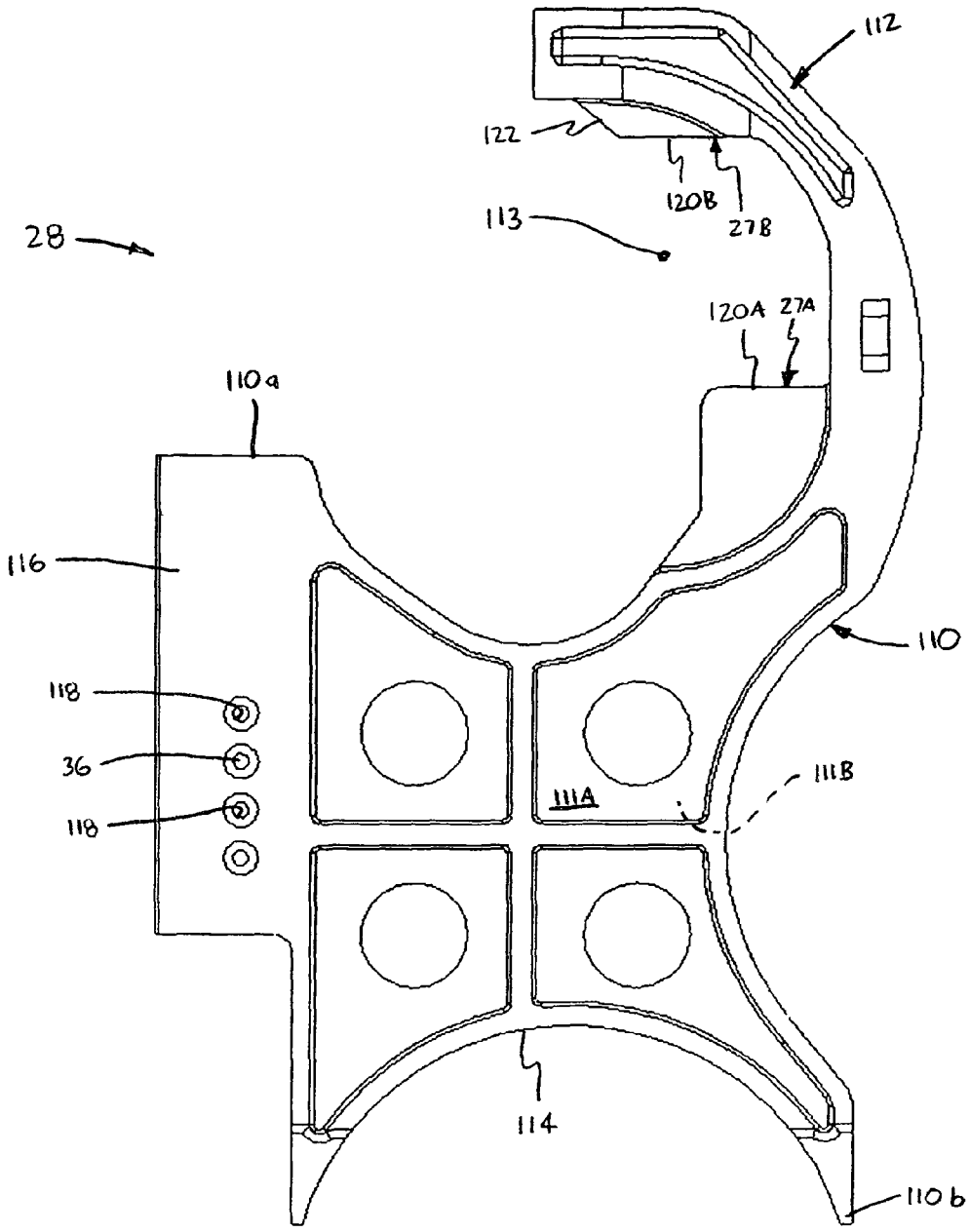
FIG. 17 is an enlarged, front plan view of the clutch actuator body modified for use with the override mechanism.
Figure 19:
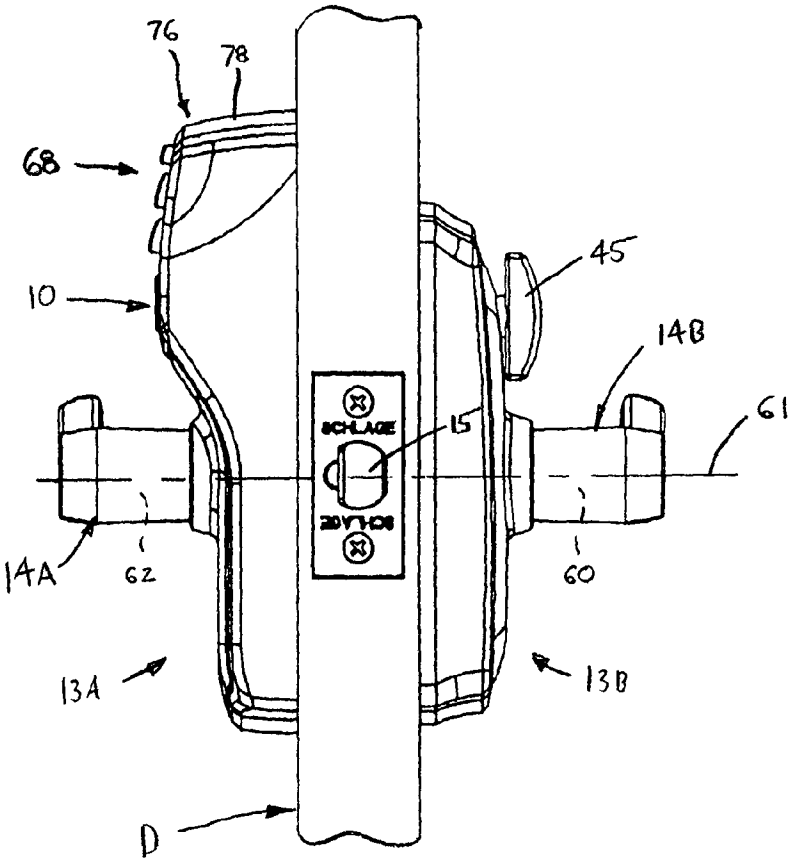
FIG. 19 is a side elevational view of the lock assembly of FIG. 19.
Figure 18:
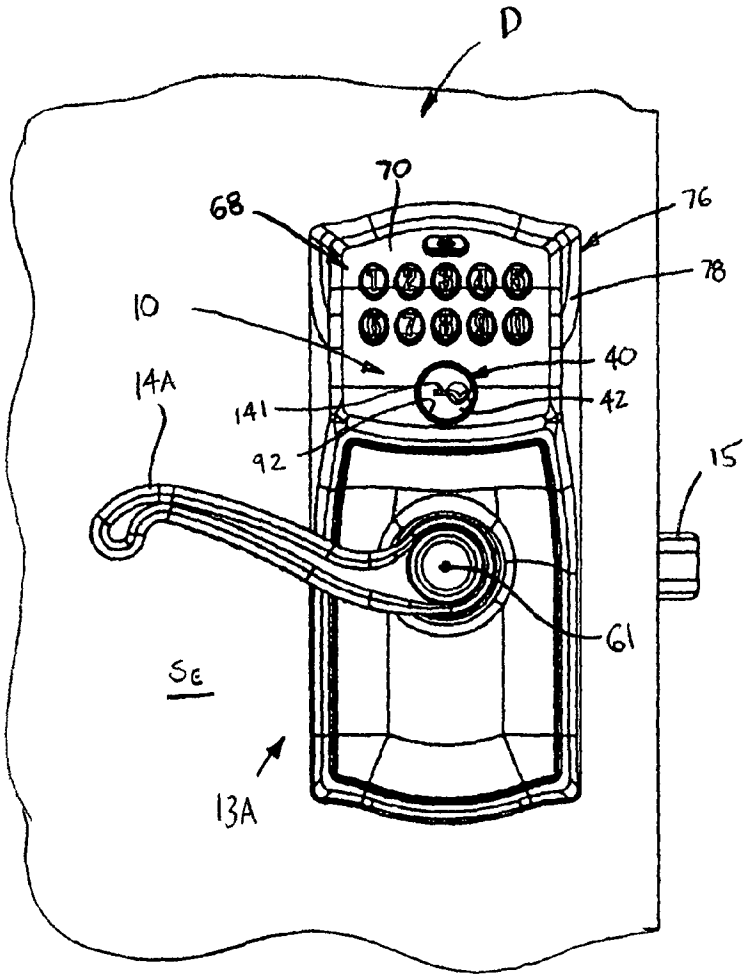
FIG. 18 is a front elevational view of a second construction of an electromechanical lock assembly that includes an override mechanism in accordance with a second embodiment of the present invention, the lock assembly being shown mounted to a door.

As shown in FIGS. 5-12 and 15-17, the override member cam 50 of the first construction is preferably generally ovular and includes a main plate 125 and central, generally circular hub 126, as best shown in FIG. 16. The hub 126 is disposeable within the base override bearing hole 86 to rotatably mount the override member 24 to the lock base 54. A pair of guide pegs 128A, 128B extend from a rear surface 125*b* of the main plate 125 and are each disposed in a separate base guide slot 88A, 88B, as discussed above, and the drive post 52 extends from the plate front surface 125*a*. The cam pusher section 51 is preferably formed as generally triangular section 125*a* of the plate 125 extending generally radially outwardly from the remainder of the plate 125, and has a curved contact surface 127 contactable or engageable with the clutch body surfaces 120A, 120B, and 122, as described below. Further, the bearing hole 86 is located generally on the clutch body axis 29 and is vertically located so as to position the override member pusher section 51 within the clutch body opening 113 so as to be at least partially disposed between the two actuator body contact surfaces 120A, 120B. As such, the cam pusher section 51 is contactable with the first, lower surface 120A when disposed in the unlock position $O_U$ and is alternatively contactable with the second, upper surface 120B when disposed in the lockout position $O_L$.

In other words, the override member pusher section 51 pushes against the body first contact surface 120A when moving in the clockwise direction $o_1$ toward the unlock position $O_U$, so as to displace the coupler 20 to the engaged position $C_E$. Alternatively, the override pusher section 51 pushes against the body second contact surface 120B when moving in the counterclockwise direction $o_2$ toward the lockout position $O_L$, to thereby displace the actuator body 28 toward the inoperative position $B_L$ and thus into locking engagement with the override member 24. More specifically, as the override member 24 rotates in the counterclockwise direction $o_2$, the pusher section 51 contacts and pushes against the upper contact surface 120B to displace the clutch body 28 in the upward direction $b_2$ until the pusher contact surface 127 displaces completely across the clutch body contact surface 120B. Then, the override contact surface 127 becomes disposed against, and engages with, the clutch body retention surface 122, such that the override member 24 retains or releasably locks the clutch body 28 in the inoperative position $B_L$. The override member 24 is retained in the lockout position both by the interaction between the contact surface 127 and the clutch body retention surface 122, which prevents rotation in the clockwise direction $o_1$, and by the interaction between the proximal guide peg 128A and the stop surface 89 of the base guide slot 88A, which prevents rotation in the counterclockwise direction $o_2$.

Further, the clutch body biasing spring 124 functions to maintain contact between the override member 24 and the clutch actuator body 28 by biasing the actuator body 28 in the downward direction $b_1$, such that the retention surface 122 is pushed against the override member pusher surface 127. The override member 24 will remain in the lockout position $O_U$ until the cylinder lock 40 exerts a sufficient force on the drive post 52, as indicated in FIG. 12, to rotate the override member 24 in the clockwise direction with sufficient torque such that the contact surface 127 pushes against the retention surface 122 and displaces the actuator body 28 upwardly against the torsion spring 124 until the contact surface 127 becomes disposed against the body upper contact surface 120B. Thereafter, the drive cylinder lock 42, and/or the combined effects of the spring 124 and gravity, displaces the override member 24 to the neutral position $O_N$ and the clutch actuator body 28 to the initial position $B_I$.

Figure 26:
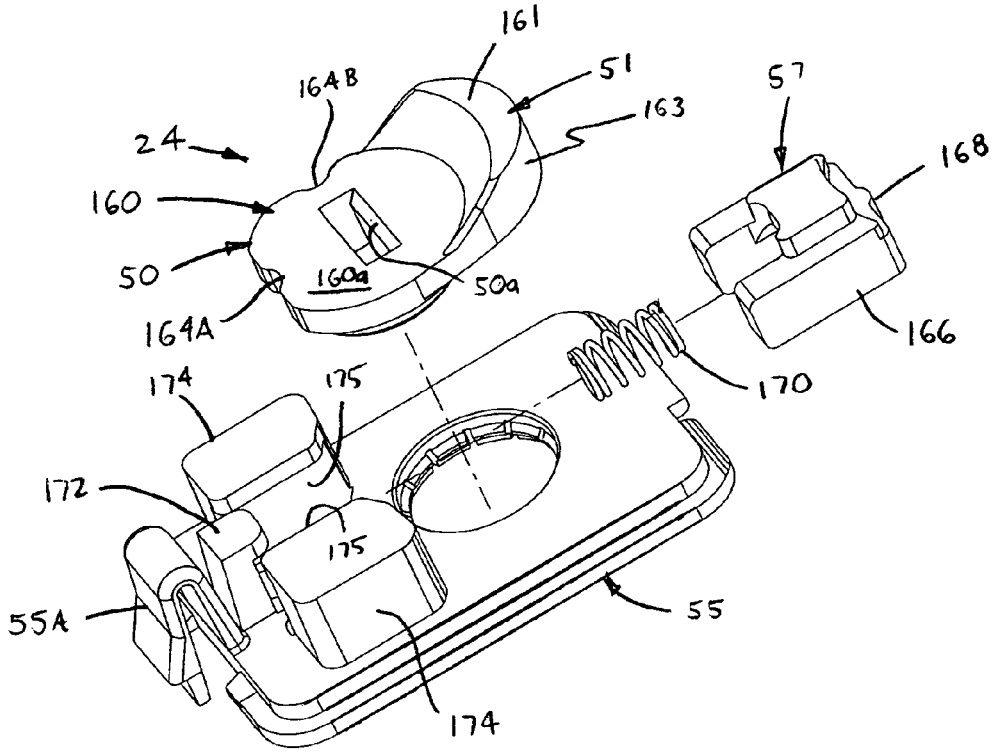
FIG. 26 is an exploded view of the override member assembly of the second construction.
Figure 27:
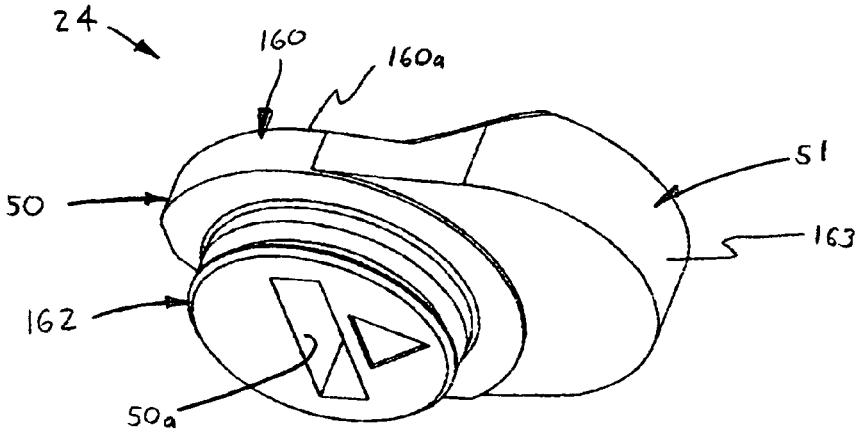
FIG. 27 is a rear perspective view of the second construction override member.

Referring to FIGS. 22-27, the override member cam 50 of the second construction is preferably generally rectangular and includes a main plate 160 and central, generally circular hub 162. The hub 162 is disposeable within a circular bearing hole 164 in the override base 55 to rotatably mount the override member 24 to thereto, as best shown in FIG. 26. The main plate 160 includes a relatively thicker section 161 extending outwardly from the plate front surface 160*a* that provides the cam pusher section 51, which has a curved contact surface 163 contactable or engageable with the clutch body contact surfaces 153A, 153B, as described below, and two retention notches 164A, 163B. The retainer 57 includes a lock member 166 with a projection 168 separately disposeable within the two plate notches 164A, 164B, so as to retain the override member cam 50 in the neutral position $O_N$ and the lockout position $O_L$, respectively, and a spring 170. The spring 170 extends between the lock member 166 and a post 172 extending from the override base 55 and biases the lock member 166 generally against the cam plate 160, and a pair of spaced-apart guide blocks 174 connected with the base 55 provide bearing surfaces 175 for the lock member 166. Further, when the override base assembly 51 is connected with the lock base plate 82, the base bearing hole 164 is located generally on the clutch body axis 29 and is vertically located so as to position the override member pusher section 51 within the clutch body opening 151 so as to be at least partially disposed between the two actuator body contact surfaces 153A, 153B. As such, the cam pusher section 51 is contactable with the first, lower surface 153A when disposed in the unlock position $O_U$ and is alternatively contactable with the second, upper surface 153B when disposed in the lockout position $O_L$.

In other words, the override member pusher section 51 pushes against the body first contact surface 153A when moving in the clockwise direction $o_1$ toward the unlock position $O_U$, so as to displace the coupler 20 to the engaged position $C_E$. Alternatively, the override pusher section 51 pushes against the body second contact surface 153B when moving in the counterclockwise direction $o_2$ toward the lockout position $O_L$, to thereby displace the actuator body 28 toward the inoperative position $B_L$ and thus into locking engagement with the override member 24. More specifically, as the override member 24 rotates in the counterclockwise direction $o_2$, the pusher section 51 contacts and pushes against the upper contact surface 153B to displace the clutch body 28 in the upward direction $b_2$ until the cam 50 has rotated by about ninety degrees (90°) from the neutral position $O_N$, at which point the lock projection 168 engages with the second plate notch 164B. Thereby, the override member 24 is retained in the lockout position $O_L$ so as to releasably lock the clutch body 28 in the inoperative position $B_L$. The override member 24 will remain in the lockout position $O_U$ until the cylinder lock 40 is used to rotate the override member 24 in the clockwise direction $o_1$, so as to first disengage the lock projection 168 from the second notch 164B and then to angularly displace the override member 24 in a clockwise direction $o_1$ by about ninety degrees (90°) until returning to the neutral position $O_N$. At which point, the lock projection 168 becomes disposed in the plate first notch 164A to releasably retain the override member 24 at the neutral position $O_N$.

Referring now to FIGS. 1-5 and 9-12 and 17-22, the cylinder lock 42 is preferably a commercially available, key-operated cylinder lock including a rotatable plug 140 disposed within a cylindrical housing 142, the output member 44 being attached to the inner end 140*a* of the plug 140. As discussed above, the lock output member 44 of the first construction is preferably formed as a generally rectangular cam plate 146 rotatable about an axis (not indicated) that is generally collinear with the override member axis 25. The cam plate 146 has opposing side edges 148A, 148B that are each separately contactable with the override member drive post 52 to drive or push the post 52, and thereby the override member 24, in opposing directions $o_1$, $o_2$ about the override axis 25. Also as discussed above, the output member 44 of the second construction is disposed within the override cam central opening 51 such that the override member 24 rotates with the plug 140. In either construction, when the proper key (none shown) is inserted into the lock keyway 141, the plug 140 is rotatable within the housing 142 to displace the lock output cam 44, and thereby displace the member 24 in a manner as described above and in further detail below. Although the lock output member 44 is preferably a cam plate 146 or a rectangular prong, the output member 44 may be constructed in any appropriate manner capable of displacing the particular override member 24, such as for example, a link, gear, etc. of a linkage, gear train, etc. configured to displace the override member 24 in an intended manner (no alternative shown).

In use, the override mechanism 10 of the present invention functions generally as follows. When an electronic component of the lock assembly 12 has failed, such that the controller cannot receive inputs or communicate with the motor, or the motor is non-functional, a user utilizes the override mechanism 10 in the following manner. The user inserts a key (not shown) in the plug keyway 141 of the preferred cylinder lock 42, and then "turns" the key to rotate the plug 140 in the first, clockwise direction $l_1$ such that the output cam 44 angularly displaces the override member 24 in the first, clockwise direction $o_1$ toward the unlock position $O_U$. During such movement of the override member 24, the member pusher section 51 contacts and pushes against the clutch body lower contact surface 27A until the clutch actuator body 28 is displaced a sufficient distance in the first direction $b_1$ along the axis 29 to push the coupler pin 100 into one notch 108 in the outer spindle 62, thereby operatively coupling the exterior handle 14A with the retractor 16. After the door D has been opened, the user rotates the cylinder lock 42 back to the initial configuration $L_1$, enabling the key to be removed, while the biasing member 46 displaces the coupler 20 back the nonengaged position, thereby displacing the actuator body 28 to the initial position $B_I$ and the override member 24 to the neutral position $O_N$. As such, the door D is then "locked" when subsequently closed, such that the exterior handle 14A is uncoupled from the retractor 16.

When the user desires to prevent opening of the door D "electronically", i.e., by inputting a code, using a swipe card or iButton, etc., the user may mechanically lock or "lockout" the door D as follows. The user inserts a key and rotates the cylinder lock 42 in the second, counterclockwise direction $l_2$ toward the lockout configuration $L_U$, causing the output member to rotate the override member 24 toward the lockout position $O_L$. The override member pusher section 51 contacts and pushes against the body upper contact surface 27B until the pusher surface 127 engages against the clutch body retention surface 122, or the lock member projection 168 engages with the second plate notch 164B, thereby releasably locking the clutch actuator body 28 in the inoperative position $B_L$, as described in detail above. In the first construction, the override member 24 then remains in the lockout position $O_L$ while the cylinder lock 42 rotates back to the initial configuration $L_I$ to permit the key to be removed, and in the second construction, the key is removable from the lock 42 when disposed at the lockout configuration $L_U$. Thereafter, when another user enters an authorized input through the input member 68 (e.g., the keypad 70), the controller 66 will cause the motor 30 to rotate the spring shaft 34, but the shaft 34 will not displace the actuator body 28, such that the coupler 20 remains in the nonengaged position $C_N$ and the door D remains locked. When the user again desires to permit the clutch mechanism 18 to unlock the door D, the user again inserts the key and rotates the cylinder lock 42 in the clockwise direction $l_1$ toward a lock release configuration $L_R$ (see FIG. 12), at which the lock output cam 44 contacts and displaces the override member drive post 52 to displace the override member 24 back toward the neutral position $O_N$. Thereby, the override member 24 is disengaged from the clutch actuator body 28 to enable the actuator body 28 to return to the body initial position $B_I$. The lock assembly 12 is thereafter permitted to again function electromechanically.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as generally described herein.

We claim:

1. An override mechanism for an electronic door lock assembly, the lock assembly including a handle, a retractor and an electronic clutch mechanism with a coupler and an actuator, the coupler operatively connecting the handle with the retractor when the coupler is located in an engaged position and disconnecting the handle and the retractor when the coupler is located in a nonengaged position, the actuator being operable to displace the coupler between the nonengaged position and the engaged position, the override mechanism comprising:

an override member movable between an unlocked position, a neutral position, and a locked position, the override member configured to retain the coupler at the engaged position despite actuator operation when the override member is disposed at the unlocked position to couple the handle and the retractor, to retain the coupler at the disengaged position despite actuator operation when the override member is disposed at the locked position to disconnect the handle and the retractor to prevent movement of the retractor to an open position, and to allow movement of the coupler between the engaged and nonengaged positions in response to actuator operation when the override member is in the neutral position.

2. The override mechanism as recited in claim 1 wherein the override member is configured to releasably secure a portion of the clutch actuator to prevent displacement of the coupler to the engaged position.

3. The override mechanism as recited in claim 2 wherein:

the clutch actuator includes a body displaceable between an initial position and an actuated position, the clutch actuator body being configured to displace the coupler to the engaged position when the body moves toward the actuated position; and the override member is releasably engageable with the clutch body to prevent displacement of the body toward the actuated position.

4. The override mechanism as recited in claim 3 wherein:

the clutch actuator body is further displaceable to an inoperative position, the initial position being located generally between the inoperative and actuated positions; and the override member is configured to displace the clutch actuator body to the inoperative position when the override member displaces toward the lockout position and to engage with the actuator body when the body is located at the inoperative position.

5. The override mechanism as recited in claim 3 wherein the clutch actuator body includes a retention surface facing generally toward the coupler and the override member includes an engagement surface facing generally away from the coupler and disposeable against the retention surface such that the override member prevents displacement of the actuator body in a direction toward the coupler.

6. The override mechanism as recited in claim 3 wherein the clutch actuator further includes a motor and a spring shaft having a first end connected with the motor and a second end coupled with the clutch body, the spring shaft permitting the motor to rotate while a retainer secures the clutch body in a generally fixed position.

7. The override mechanism as recited in claim 1 further comprising a manual drive configured to displace the override member between the unlock and lockout positions, the override member being configured to displace at least a portion of the clutch actuator into engagement with a retainer when the override member displaces toward the lockout position.

8. The override mechanism as recited in claim 7 wherein:

the override member is angularly displaceable about an axis between the unlock and lockout positions; and the drive includes a rotatable cylinder lock configured to angularly displace the output member about the override axis.

9. The override mechanism as recited in claim 8 wherein one of:

the override member is connected with the cylinder lock; and the cylinder lock includes an output member engageable with the override member.

10. The override mechanism as recited in claim 8 wherein:

the cylinder lock is adjustable from an initial configuration to an unlock configuration, the output member displacing the override member to the unlock position as the cylinder lock adjusts to the unlock configuration; and the cylinder lock is adjustable from the initial configuration to a lockout configuration, the output member displacing the override member to the lockout position as the cylinder lock adjusts to the lockout configuration.

11. The override mechanism as recited in claim 10 wherein:

the lock assembly further includes a biasing member configured to bias the coupler to the nonengaged position;

the override mechanism is configured to retain the coupler in the engaged position against the biasing member when a user manually retains the cylinder lock in the unlock configuration; and the biased coupler displaces the override member from the unlock position when the user releases the cylinder lock from the unlock configuration.

12. The override mechanism as recited in claim 8 wherein:

the override member includes a rotatable cam engageable with the clutch actuator and a post extending from a plate; and the cylinder lock includes an output cam contactable with the override member post such that rotation of the cylinder lock in a first direction drives the override cam to rotate in a first direction and rotation of the lock drives the override cam in a second, opposing direction.

13. The override mechanism as recited in claim 1 wherein:

the clutch actuator includes a body displaceable between an initial position and an actuated position, the body being configured to displace the coupler to the engaged position when the body moves toward the actuated position; and the override member is configured to displace the clutch actuator body to the actuated position when the override member displaces to the unlock position and to displace the actuator body generally away from the actuated position when the override member displaces toward a lockout position.

14. The override mechanism as recited in claim 13 wherein:

the clutch actuator body has spaced-apart, first and second contact surfaces; and the override member is at least partially disposed between the two body contact surfaces so as to be contactable with the first surface when disposed in the unlock position and alternatively contactable with the second surface when disposed in a lockout position.

15. The override mechanism as recited in claim 14 wherein the override member pushes against the body first contact surface when moving toward the unlock position to displace the coupler to the engaged position and alternatively pushes against the body second contact surface when moving toward the lockout position to displace of the actuator body into engagement with a retainer.

16. The override mechanism as recited in claim 14 wherein the override member is angularly displaceable about an axis in a first direction to contact the body first surface and alternatively displaceable about the axis in second, opposing direction to contact the body second surface.

17. The override mechanism as recited in claim 13 wherein the override member is disposeable at a neutral position at which the override member permits the clutch actuator body to displace between the initial and actuated positions.

18. The override mechanism as recited in claim 17 wherein the override member is angularly displaceable in opposing directions about an axis between the unlock and lockout positions, the neutral position being located generally between the unlock and lockout positions.

19. The override mechanism as recited in claim 13 wherein:

the lock further includes an inner spindle coupled with the retractor and an outer spindle coupled with the handle, the two spindles being rotatable about a lock centerline;

the coupler is connected with one of the inner and outer spindles and releasably engageable with the other one of the inner and outer spindles when disposed in the engaged position such that rotation of the outer spindle rotatably displaces the inner spindle to operate the retractor;

the clutch body further has an engagement surface contactable with the coupler such that the bearing surface pushes the coupler from the nonengaged position to the engaged position when the body displaces from the initial position toward the actuated position, the clutch body engagement surface being located at a most proximal position with respect the lock centerline when the override member is disposed in the unlock position; and a retainer is engageable with the clutch body so as to retain the body engagement surface at a most distal position with respect to the lock centerline.

20. The override mechanism as recited in claim 13 wherein:

the clutch actuator further includes a motor and a spring shaft having a first end connected with the motor and a second end coupled with the clutch actuator body such that when a retainer is nonengaged with the clutch, rotation of the motor in a first direction displaces the body generally toward the coupler and rotation of the motor in a second, opposing direction moves the actuator body generally away from the coupler; and the retainer is engageable with the actuator body so as to prevent displacement of the body generally toward the coupler, the spring shaft permitting the motor to rotate while the retainer secures the body in a generally fixed position.

21. The override mechanism as recited in claim 13 wherein:

the lock further includes a biasing member configured to bias the coupler toward the nonengaged position;

the override mechanism further comprise a manually operable drive configured to displace the override member to the unlock position such that the clutch body is displaced to the body actuated position; and the biased coupler displaces the clutch actuator body to the body initial position so as to move the override member to a neutral position when the drive member is released with the body at the actuated position.

22. The override mechanism as recited in claim 1 wherein:

the clutch actuator includes a body with spaced-apart, first and second contact surfaces, the body being engageable with the coupler such that movement of the body displaces the coupler between the nonengaged and engaged positions; and the override member is at least partially disposed between the two contact surfaces so as to be contactable with the first surface when disposed in the unlock position and alternatively contactable with the second surface when disposed in a lockout position.

23. The override mechanism as recited in claim 1 wherein:

the clutch actuator includes a body and a motor with a rotatable shaft, the body being displaceable between an initial position and an actuated position and configured to displace the coupler to the engaged position when the body moves toward the actuated position, the motor shaft being operatively coupled with the body such that rotation of the shaft in a first direction displaces the body toward the actuated position and rotation of the motor in a second direction displaces the body generally away from the actuated position; and a retainer is configured to retain the actuator body substantially immovable during motor shaft rotation.

24. The override mechanism as recited in claim 1 wherein the lock assembly further includes a housing mountable to a door and having an interior chamber, each one of the coupler, the clutch actuator, the override member, and a retainer being contained within the housing chamber.

25. The override mechanism as recited in claim 1 wherein the lock assembly includes a base mountable to a door, the override member being rotatably coupled with the base and a retainer being connected with the base.

26. An actuator assembly for a door lock assembly, the lock assembly including a movable latch, a retractor for displacing the latch and a handle for operating the retractor, the actuator assembly including:

a clutch mechanism including a coupler and an actuator, the coupler being configured to operatively connect the handle with the retractor when the coupler is located in an engaged position and to disconnect the handle and the retractor when the coupler is in a nonengaged position, and an actuator operable to displace the coupler between the nonengaged position and the engaged position;

a movable override member configured to displace the coupler between the nonengaged and engaged positions, the override member movable to one of an unlocked position wherein the coupler is maintained in the engaged position despite actuator operation, a locked position wherein the coupler is maintained in the nonengaged position despite actuator operation, and a neutral position wherein the coupler moves between the engaged position and the nonengaged position in response to actuator operation; and a retainer configured to prevent displacement of the coupler to the engaged position during actuator operation to prevent using the handle to move the retractor to an open position when the override member is in the locked position.

27. The actuator assembly of claim 26, wherein the override member is movable to a lockout position to prevent movement of the coupler to the engaged position.

28. A door lock assembly comprising:

a latch engageable with a strike;

a retractor configured to displace the latch;

a handle operatively coupleable with the retractor;

a coupler configured to operatively connect the handle with the retractor and displaceable between an engaged position at which the handle is coupled with the retractor and a nonengaged position at which the handle is noncoupled with the retractor;

an electronic actuator configured to displace the coupler between the engaged and nonengaged positions;

a movable override member configured to displace the coupler between the nonengaged and engaged positions and to retain the coupler at the engaged position when the override member is disposed at an unlock position such that the handle is operatively coupled to the retractor regardless of the electronic actuator configuration; and a retainer configured to prevent displacement of the coupler to the engaged position during actuator operation such that the handle is not operatively coupled to the retractor and the handle is unable to move the retractor to an open position when the override member is in the locked position, wherein the override member is movable to a lockout position to prevent movement of the coupler to the engaged position.

* * * * *